US008318396B2

(12) United States Patent
Fujita et al.

(10) Patent No.: US 8,318,396 B2
(45) Date of Patent: Nov. 27, 2012

(54) ORGANIC PHOTORECEPTOR AND PREPARATION METHOD THEREOF

(75) Inventors: Toshiyuki Fujita, Tokyo (JP); Hirofumi Hayata, Tokyo (JP); Takeshi Ishida, Tokyo (JP); Masahiko Kurachi, Tokyo (JP); Seisuke Maeda, Tokyo (JP); Seijiro Takahashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 171 days.

(21) Appl. No.: 12/845,990

(22) Filed: Jul. 29, 2010

(65) Prior Publication Data

US 2011/0039197 A1 Feb. 17, 2011

(30) Foreign Application Priority Data

Aug. 12, 2009 (JP) ..... 2009-187015

(51) Int. Cl.
*G03G 5/00* (2006.01)

(52) U.S. Cl. ..... 430/66; 430/132

(58) Field of Classification Search ..... 430/66, 430/132

See application file for complete search history.

(56) References Cited

U.S. PATENT DOCUMENTS

2006/0160002 A1* 7/2006 Qi et al. ..... 430/58.2
2010/0086328 A1* 4/2010 Fujita et al. ..... 399/111

FOREIGN PATENT DOCUMENTS

JP 2000275877 10/2000
JP 2001125299 5/2001
JP 2002229240 8/2002

* cited by examiner

*Primary Examiner* — Mark A Chapman
(74) *Attorney, Agent, or Firm* — Lucas & Mercanti, LLP

(57) ABSTRACT

An organic photoreceptor is disclosed, comprising, on an electrically conductive support, a photosensitive layer and a protective layer containing metal oxide particles produced by a plasma method, and the protective layer being formed by curing a composition containing the metal oxide particles and a curable compound. There is also disclosed a preparation method of the organic photoreceptor.

16 Claims, 3 Drawing Sheets

ORGANIC PHOTORECEPTOR AND PREPARATION METHOD THEREOF

This application claims priority from Japanese Patent Application No. 2009-187015, filed on Aug. 12, 2009, which is incorporated hereinto by reference.

FIELD OF THE INVENTION

The present invention relates to an organic photoreceptor for use in an electrophotographic image forming apparatus and a preparation method of the same.

BACKGROUND OF THE INVENTION

Recently, there have been broadly used organic electrophotographic photoreceptors (hereinafter, also denoted simply as organic photoreceptor or photoreceptor) containing an organic photoconductive material, as an electrophotographic photoreceptor. Organic photoreceptors are advantageous over other photoreceptors in the respects that of a material corresponding to various kinds of light sources of visible to infrared light are easily developable, a material having no environmental pollution can be chosen and production cost is low, but still have some problems that mechanical strength is low, deterioration or flaws of the photoreceptor surface easily occurs in copying or printing of a large number of sheets and durability is insufficient.

To solve problems such as durability of an organic photoreceptor being insufficient, it has been strongly sought to inhibit abrasion due to scratching by a cleaning blade. As an approach therefor have been studied techniques of providing a protective layer with a high strength on the surface of the photoreceptor or the like.

For instance, there was reported the use of a curable siloxane resin containing a colloidal silica for the photoreceptor surface (as described in, for example, JP 2000-275877A). In such a curable siloxane resin containing a colloidal silica, however, not only a curable resin with a siloxane bonding (Si—O—Si bond) but also colloidal silica which exhibits high hygroscopicity and the electric resistance of the surface layer is easily lowered, producing problems that image unsharpness or image swearing easily occurs.

In another embodiment, there was proposed a protective layer of a curable resin obtained by photo-polymerization of a compound containing an acryloyl group or the like (as described in, for example, JP 2001-125299A). In such a protective layer, a filler of a metal oxide or the like was incorporated in the curable resin, however, in the prior art, dispersibility of the filler in the curable resin was insufficient and bonding of the filler to the curable resin was weak through a hydrogen bond or the van der Waals force, so that although the strength of the curable resin was relatively high, detachment of the filler often occurred and strength as a protective layer was insufficient and such image unsharpness or image smearing was not sufficiently solved.

On the other hand, there was proposed a technique of using metal oxide particles produced via a plasma method (as described in, for example, JP 2002-229240A). It was known that such metal oxide particles produced via a plasma method were small and uniform in particle size and superior in dispersibility, as compared to convention ones, resulting in effective inhibition of leakage occurrence. However, the metal oxide particles produced via the plasma method exhibited enhanced surface activity and easily adsorbed moisture or discharge products under high temperature and high humidity, producing problems such that image unsharpness readily occurred. Further, in the prior art, a binder resin employed a linear polymeric material with a relatively low strength and the difference in strength from a metal oxide was great so that flaws easily occurred, producing problems such that filming was generated from such flaws as the starting point.

SUMMARY OF THE INVENTION

It is an object of the present invention to provide an organic photoreceptor which has improved abrasion resistance and is capable of forming an image with enhanced durability and superior image quality without causing image smearing, image unsharpness or filming, and an image forming apparatus by use of the organic photoreceptor.

As a result of extensive study of a protective layer applicable to an organic photoreceptor, while thrashing out problems in conventional protective layers and undergoing study of various improvements thereof, it was found that the use of a protective layer obtained by reactively curing the composition containing particulate metal oxide formed by a plasma method and a curable compound achieved prevention of image smearing, image unsharpness or filming, whereby the present invention has come into being.

One aspect of the present invention is directed to an organic photoreceptor comprising, on an electrically conductive support, a photosensitive layer and a protective layer containing metal oxide particles, wherein the metal oxide particles are those produced by a plasma method and the protective layer is one which has been formed by curing a composition containing a curable compound and metal oxide particles.

Another aspect of the present invention is directed to a method of preparing an organic photoreceptor, as described above, the method comprising the steps of:

coating a composition containing metal oxide particles and a curable compound on the photosensitive layer and allowing the curable compound to be cured to form the protective layer, wherein the metal oxide particles are those which have been formed by a plasma method.

Further, another aspect of the present invention is directed to an image forming apparatus comprising a charger, a light exposure device and a developing device together with an organic photoreceptor, wherein the organic photoreceptor is one described above.

The use of the organic photoreceptor of the invention achieves improved abrasion resistance thereof; and making it feasible to obtain images with enhanced durability and superior image quality without causing image smearing, image unsharpness or filming, and an image forming apparatus by use of the organic photoreceptor.

DETAILED DESCRIPTION OF THE INVENTION

Figure 1:
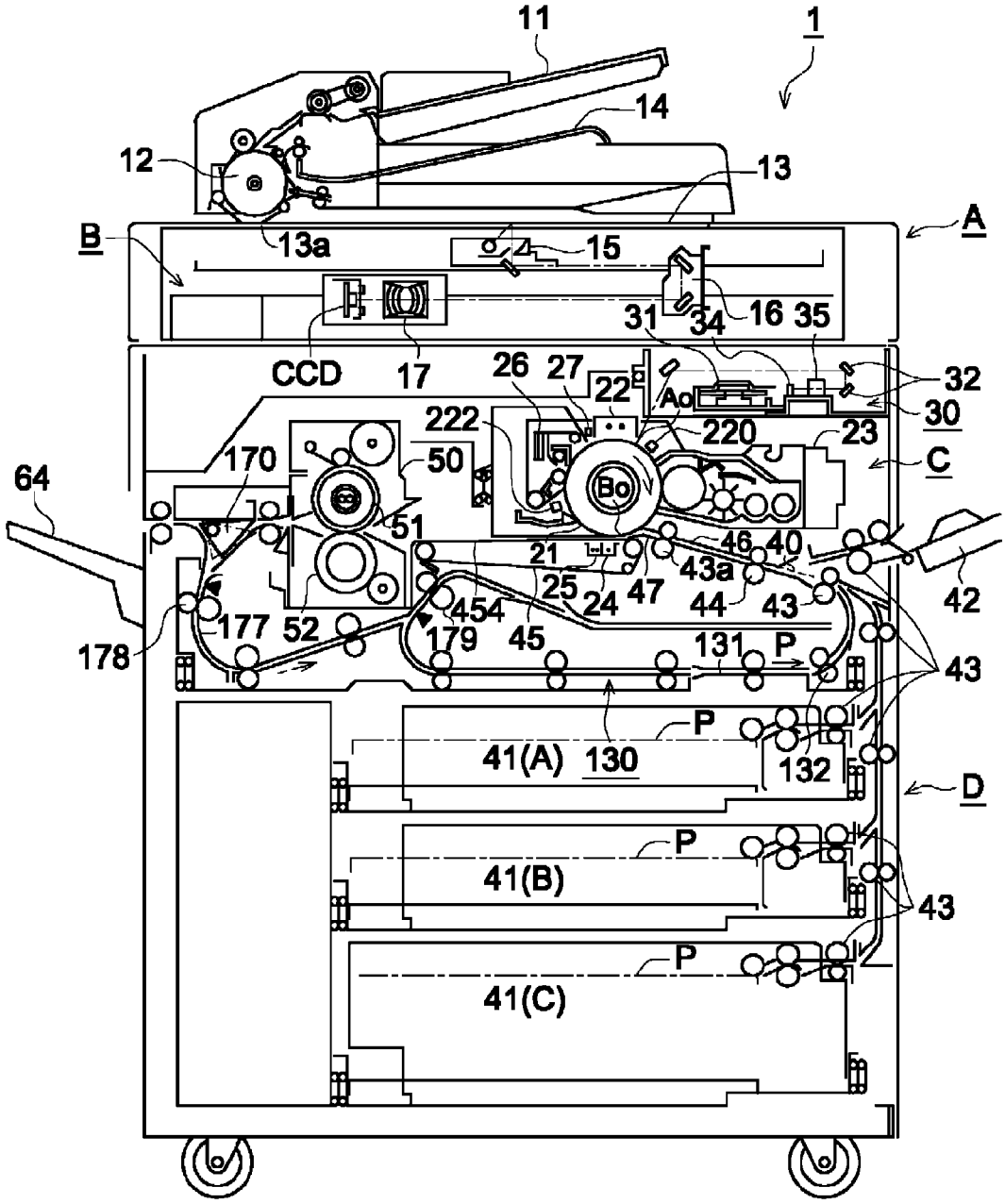
FIG. 1 illustrates an image forming apparatus relating to the invention.

The present invention relates to an organic photoreceptor provided with a photosensitive layer and a protective layer containing metal oxide particles formed by a plasma method on an electrically conductive support, a preparation method of the organic photoreceptor and an image forming apparatus by use of the organic photoreceptor.

In the invention, the organic photoreceptor is featured in that a protective layer is formed by allowing a composition containing the metal oxide particles formed by a plasma method and a curing compound to be reactively cured.

In the invention, the organic photoreceptor having the foregoing constitution has achieved a remarkable improvement in strength to abrasion or scratching of the photoreceptor surface, improved abrasion resistance and specifically, prevention of occurrence of image smearing filming.

There is presumed a mechanism described below as the reasons for the effects of the invention.

Metal oxide particles produced by a plasma method are characterized by their high dispersibility (i.e., enhanced capability of being dispersed). Uniformity of dispersion is further enhanced by use of a low-molecular curable compound (monomer or oligomer) in place of a conventionally used high-molecular binder. It is presumed that when metal oxide particles produced by a plasma method are dispersed in the solution of a curable compound, the particle surface is effectively covered with a low molecular curable compound.

Such a phenomenon is more effective than the use of metal oxide particles produced by other processes and is remarkably exhibited by the combination of metal oxide particles produced by a plasma method and a low molecular curable compound.

Further, it is assumed that coverage of the metal oxide particle surface with a curable compound shields characteristic activity of metal oxide particles produced by a plasma method and after forming a coating of the composition containing the particles and the curable compound, the curable compound is cured to form a cured coating, which inhibits unnecessary adsorption into the inside of the protective layer and results in modified image unsharpness; further, curing a curable compound to form a protective layer results in enhanced strength of the cured resin, rendering it difficult to cause surface flaws or the like, and resulting in marked reduction of filming.

Inclusion of a component obtained by reaction of the metal oxide particles and the curable compound is also an effective embodiment in which an improvement of abrasion resistance, modification of image unsharpness under high temperature and high humidity, and the like are achieved.

There will be described metal oxide particles produced by a plasma method, related to the invention.

The metal oxide particles of the invention may be an oxide of any metal including a transition metal. Examples thereof include silica (silicon oxide), magnesium oxide, zinc oxide, lead oxide, alumina (aluminum oxide), tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, and vanadium oxide. Of these, particles of titanium oxide, alumina, zinc oxide or tin oxide are preferred.

Conventional electrophotographic photoreceptors have employed zinc oxide, titanium oxide or the like, as metal oxide particles contained in a protective layer which is produced as below. Namely, there has been employed zinc oxide produced by an indirect method (also known as French method) or a direct method (also known as American method), as described in JIS K 1410. In the indirect method (French method), metallic zinc is heated at 1000 C and vaporized zinc is oxidized by heated air. The formed zinc oxide is cooled through aerial cooling by using a blower and classified in accordance with particle size. In the direct method (American method), zinc oxide obtained by burning zinc ore is reduced with coal and vaporized zinc is oxidized by heated air, or slag obtained by leaching zinc ore with sulfuric acid is burned together with coke in an electric furnace and fused zinc is oxidized by heated air. Then, a treatment similar to the indirect method is conducted. There is also conducted a wet method in which a hydrochloric acid solution of zinc is precipitated with an alkaline solution and basic zinc carbonate produced is burned.

There has been used titanium oxide produced by a sulfuric acid method (or sulfuric acid processing method) or a chlorine method (or chlorine processing method) as a production method for use in conventional industrial production. The sulfuric acid method is comprised of basic steps of reacting an ore with sulfuric acid to prepare a sulfuric acid solution, clarifying the solution, precipitating hydrous titanium oxide through hydrolysis, washing the hydrous titanium oxide, burning, and grinding/surface treatment. In the chlorine method, an ore is chlorinated to prepare a titanium tetrachloride solution, which is subjected to rectification and burning with oxygen to form titanium oxide, followed by grinding and a post-treatment. In addition, production methods of a titanium oxide include a hydrofluoric acid method, a potassium titanium chloride method, and an aqueous titanium tetrachloride method.

However, conventional metal oxide particles produced by the foregoing methods have a particle size of about 0.2 to 0.4 μm, which is a little too large for use in the surface layer of an organic photoreceptor, producing problems such as remarkable damage to peripheral members.

On the contrary, metal oxide particles produced through a plasma method (or plasma processing method) have a smaller average particle size than conventional ones and exhibiting a crystal habit of particle shape being relatively uniform.

The metal oxide particles related to the invention employ metal oxide particles produced by a plasma method. Methods of producing metal oxide particles through a plasma method include a direct current plasma arc method, a high frequency plasma method and a plasma jet method.

In the direct current plasma arc method, a metallic raw material is used as a consumptive anode electrode and a plasma flame is generated from a cathode electrode. A metallic raw material on the anode side is heated and evaporated, and the metallic raw material vapor is oxidized and cooled to obtain metal oxide particles.

The high frequency plasma method employs a thermal plasma generated when heating a gas under atmospheric pressure by high-frequency induction discharge. In a plasma evaporation method, solid particles are charged into the center of an inert gas plasma and evaporated while passing through the plasma, and this high-temperature vapor is rapidly cooled and condensed to form ultra-fine particles.

In the plasma method, when discharged in an atmosphere of argon as an inert gas, or hydrogen, nitrogen or oxygen as a diatomic molecule gas, argon plasma, hydrogen plasma or the like is obtained. Specifically, hydrogen (nitrogen or oxygen) plasma generated on thermal dissociation of a diatomic molecule, which is highly reactive, compared to atomic gas, is also called a reactive arc plasma and distinguished from the plasma of inert gas. Of these, an oxygen plasma method is effective as a method of forming metal oxide particles.

The number average primary particle size of the metal oxide particles of the invention is preferably within the range of from 1 to 300 nm, and more preferably from 3 to 100 nm.

The number average primary particle size of metal oxide particles is determined in such a manner that after macrophotographed at 10,000 fold by a scanning electron microscope (made by Nippon Denshi), photographic images of 300 particles (except for coagulated particles) randomly loaded to a scanner were analyzed by using an automatic image processing analyzer LUZEX AP (made by NIRECO Corp.) to calculate a number average primary particle size.

Surface Treatment Agent

In the invention, metal oxide particles produced by a plasma method exhibit advantageous effects even when not subjected to a surface treatment but when surface-treated with a surface treatment agent, bonding to a curable compound becomes stronger.

Next, there will be described a surface treatment agent used for the surface treatment of metal oxide particles.

A surface treatment agent used for the surface treatment of the foregoing metal oxide particles may be any one which is reactive with a hydroxyl group or the like, existing on the surface of the metal oxide particles. Such reactive surface treatment agents include compounds shown below:

S-1 $CH_2{=}CHSi(CH_3)(OCH_3)_2$
S-2 $CH_2{=}CHSi(OCH_3)_3$
S-3 $CH_2{=}CHSiCl_3$
S-4 $CH_2{=}CHCOO(CH_2)_2Si(CH_3)(OCH_3)_2$
S-5 $CH_2{=}CHCOO(CH_2)_2Si(OCH_3)_3$
S-6 $CH_2{=}CHCOO(CH_2)_3Si(CH_3)(OCH_3)_2$
S-7 $CH_2{=}CHCOO(CH_2)_3Si(OCH_3)_3$
S-8 $CH_2{=}CHCOO(CH_2)_2Si(CH_3)Cl_2$
S-9 $CH_2{=}CHCOO(CH_2)_2SiCl_3$
S-10 $CH_2{=}CHCOO(CH_2)_3Si(CH_3)Cl_2$
S-11 $CH_2{=}CHCOO(CH_2)_3SiCl_3$
S-12 $CH_2{=}C(CH_3)COO(CH_2)_2Si(CH_3)(OCH_3)_2$
S-13 $CH_2{=}C(CH_3)COO(CH_2)_2Si(OCH_3)_3$
S-14 $CH_2{=}C(CH_3)COO(CH_2)_3Si(CH_3)(OCH_3)_2$
S-15 $CH_2{=}C(CH_3)COO(CH_2)_3Si(OCH_3)_3$
S-16 $CH_2{=}C(CH_3)COO(CH_2)_2Si(CH_3)Cl_2$
S-17 $CF_{12}{=}C(CH_3)COO(CH_2)_2SiCl_3$
S-18 $CH_2{=}C(CH_3)COO(CH_2)_3Si(CH_3)C_{12}$
S-19 $CH_2{=}C(CH_3)COO(CH_2)_3SiCl_3$
S-20 $CH_2{=}CHSi(C_2H_5)(OCH_3)_2$
S-21 $CH_2{=}C(CH_3)Si(OCH_3)_3$
S-22 $CH_2{=}C(CH_3)Si(OC_2H_5)_3$
S-23 $CH_2{=}CHSi(OCH_3)_3$
S-24 $CH_2{=}C(CH_3)Si(CH_3)(OCH_3)_2$
S-25 $CH_2{=}CHSi(CH_3)Cl_2$
S-26 $CH_2{=}CHCOOSi(OCH_3)_3$
S-27 $CH_2{=}CHCOOSi(OC_2H_5)_3$
S-28 $CH_2{=}C(CH_3)COOSi(OCH_3)_3$
S-29 $CH_2{=}C(CH_3)COOSi(OC_2H_5)_3$
S-30 $CH_2{=}C(CH_3)COO(CH_2)_3Si(OC_2H_5)_3$

S-31

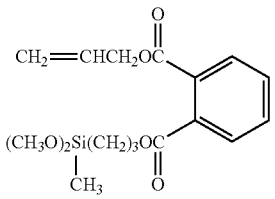

S-32

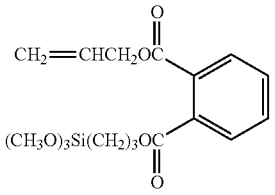

-continued

S-33

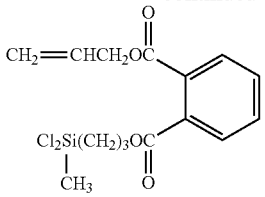

S-34

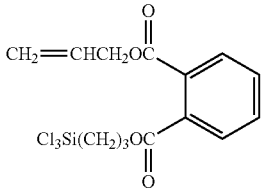

S-35 $(CH_3O)_3SiC_3H_6OCH_2CH{-}CH_2$ (O)

S-36 $(C_2H_5O)_2Si(CH_3)C_3H_6OCH_2CH{-}CH_2$ (O)

S-37 $(C_2H_5O)_3SiC_3H_6OCH_2CH{-}CH_2$ (O)

The reactive organic group related to the invention is preferably at least a radical-polymerizable group and more preferably, such a radical-polymerizable group is a group having a carbon-carbon double bond.

Specifically preferable, the radical-polymerizable group is an acryloyl group or methacryloyl group, which is highly effective for abrasion resistance of a protective layer and improvements of image smearing or image unsharpness often caused under high temperature and high humidity.

In the following, a production method of metal oxide particles having a reactive organic group will be described by exemplifying titanium oxide particles.

Titanium oxide particles having a reactive organic group, related to the invention can be obtained by subjecting titanium oxide particles to a surface treatment by use of a silane compound having a reactive organic group. In the surface treatment, it is preferred to use a silane compound as a surface treatment agent in an amount of 0.1 to 200 parts by mass per 100 parts by mass of titanium oxide, together with a solvent of 50 to 5000 parts by mass.

Next, there will be described a surface treatment method to produce titanium oxide particles which were finely and uniformly surface-covered with a silane compound.

First, a slurry (suspension of solid particles) containing titanium oxide particles and a surface treatment agent of a silane compound is subjected to wet grinding, whereby the titanium oxide particles are further finely ground, while the surface treatment of the titanium oxide particles proceeds. Thereafter, removal of the solvent resulted in a powdered product and thereby are obtained titanium oxide particles which are uniformly and finely surface-treated with the silane compound.

A wet media dispersion type apparatus as a surface treatment apparatus used in the invention is an apparatus which is provided with a vessel filled with beads as a media and has a process of grinding and dispersing aggregated metal oxide particles by rotating a stirring disc fitted vertically to a rotation axis at a high-speed. There is applicable any apparatus capable of performing sufficient dispersion of metal oxide particles when surface-treating the metal oxide particles and various types are usable, including a longitudinal type, a horizontal type, a continuous type, a batch type and the like.

Specific examples thereof include a sand mill, ultra-visco mill, pearl mill, grain mill, dyno mill, agitator mill, dynamic mill and the like. These dispersing devices can perform fine-grinding and dispersion through impact compressive-destruction, friction, or shearing stress by using grinding media such as balls or beads.

Balls made from a raw material such as glass, alumina, zircon, zirconia, steel, flint stone or the like are usable as beads for use in the foregoing sand grinder mill, and those made from zirconia or zircon are preferable. The bead size is usually usable in a diameter of 1 to 2 mm but in the present invention, a diameter of 0.1 to 1.0 mm is preferable.

A disc or the inner wall of a vessel used in a wet media dispersion type apparatus may employ various materials such as stainless steel, nylon, ceramics and the like. In the invention, a disc or the vessel-inner wall, made of ceramics such a zirconia or silicon carbide is preferably.

Thus, titanium oxide particles which have been surface-modified with a surface treatment agent can be obtained through a wet treatment, as described above.

As described for the foregoing titanium oxide particles, metal oxide particles such as alumina, zinc oxide, tin oxide or silica also contain a hydroxyl group on the particle surface, so that metal oxide particles surface-treated with a surface treatment agent can also obtained.

Curable Compound

Next, there will be described a curable compound used for a protective layer.

The curable compound preferably is a monomer capable of polymerizing (curing) upon exposure to actinic rays such as ultraviolet rays or an electron beam to form a resin usable as a binder resin of a photoreceptor, such as polystyrene, polyacrylate or the like, and a styrene monomer, acryl monomer, methacryl monomer, vinyltoluene monomer, vinyl acetate monomer, and N-vinylpyrrolidone monomer are preferred.

Of these, a curable compound containing an acryloyl group ($CH_2{=}CHCO{-}$) or a methacryloyl group ($CH_2{=}CCH_3CO{-}$) is preferred in terms of being curable at a small amount of light or for a short period of time, and a methacryloyl group is more preferred.

In the invention, these curable compounds may be used alone or in their combination.

Specific examples of the curable compound are shown below. In the following, the expression "No. of Ac." and "No. of Mc." represent the number of acryloyl groups and the number of methacryloyl groups, respectively.

| Compound No. | Structural Formula | No. of Ac. |
|---|---|---|
| Ac-1 | 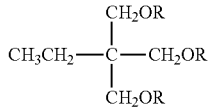 | 3 |
| Ac-2 | 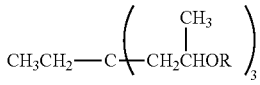 | 3 |
| Ac-3 | 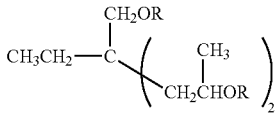 | 3 |
| Ac-4 | 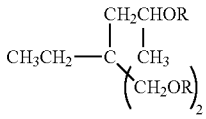 | 3 |
| Ac-5 | 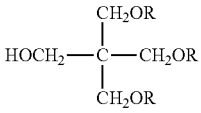 | 3 |
| Ac-6 | 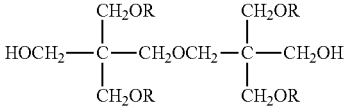 | 4 |
| Ac-7 | 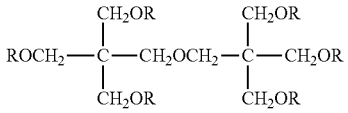 | 6 |
| Ac-8 | 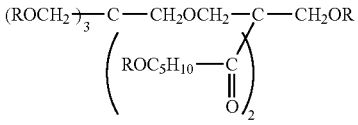 | 6 |

-continued
| Compound No. | Structural Formula | No. of Ac. |
|---|---|---|
| Ac-9 | 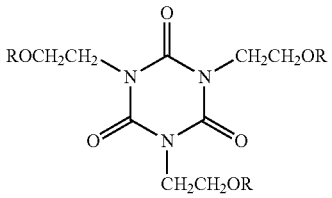 | 3 |
| Ac-10 | $CH_3CH_2C(CH_2OC_3H_6OR)_3$ | 3 |
| Ac-11 | 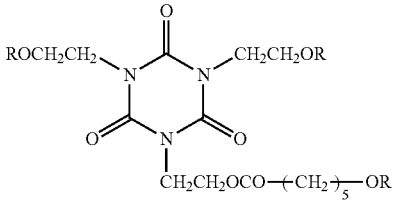 | 3 |
| Ac-12 | $(ROCH_2)_3C—O—C(CH_2OR)_3$ | 6 |
| Ac-13 | $(ROCH_2)_3C—CH_2OCH_2—C(H)(CH_2OR)_2$ | 5 |
| Ac-14 | $(ROCH_2)_3C—CH_2OCH_2—C(CH_3)(CH_2OR)_2$ | 5 |
| Ac-15 | $(ROCH_2)_3C—CH_2OCH_2—C(CH_2OH)(CH_2OR)_2$ | 5 |
| Ac-16 | $(ROCH_2)_3C—CH_2OCH_2—C(CH_2OR)(CH_2OH)_2$ | 4 |
| Ac-17 | $(ROCH_2)_3C—O—C(CH_2OH)(CH_2OR)_2$ | 5 |
| Ac-18 | 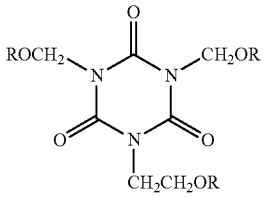 | 3 |
| Ac-19 | $CH_3CH_2C(CH_2CH_2OR)_3$ | 3 |
| Ac-20 | $HOCH_2—C\left(CH_2O—C(=O)CH_2CH_2CH_2CH_2CH_2OR\right)_3$ | 3 |
| Ac-21 | 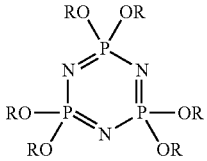 | 6 |
| Ac-22 | $R(OCH_2CH_2)_2C(CH_3)_2C_6H_4O(CH_2CH_2O)_2R$ | 2 |

-continued
| Compound No. | Structural Formula | No. of Ac. |
|---|---|---|
| Ac-23 | 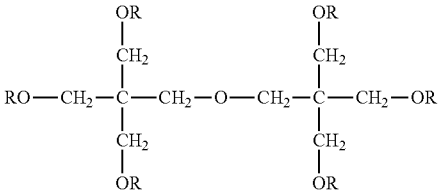 | 6 |
| Ac-24 | 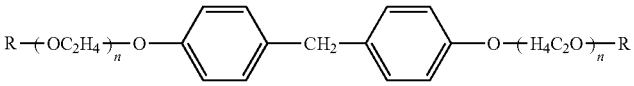 n ≈ 2 | 2 |
| Ac-25 | 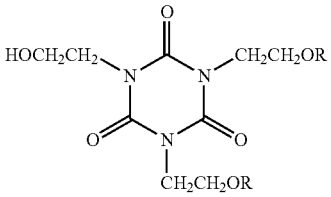 | 2 |
| Ac-26 | $R-(OC_3H_6)_3-OR$ | 2 |
| Ac-27 | 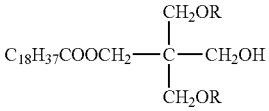 | 2 |
| Ac-28 | 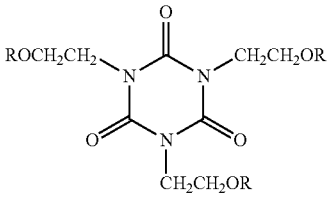 | 3 |
| Ac-29 | $[R-(OC_3H_6)_n-OCH_2]_3CCH_2CH_3$ (n ≈ 3) | 3 |
| Ac-30 | 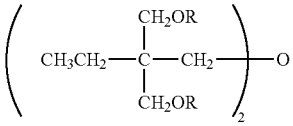 | 4 |
| Ac-31 | $(ROCH_2)_4C$ | 4 |
| Ac-32 | $RO-C_6H_{12}-OR$ | 2 |
| Ac-33 | 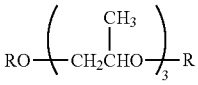 | 2 |
| Ac-34 | 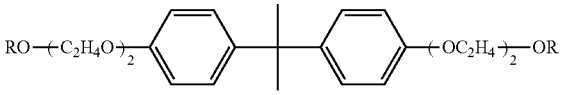 | 2 |
| Ac-35 | 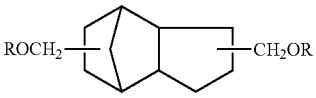 | 2 |

-continued

| Compound No. | Structural Formula | No. of Ac. |
|---|---|---|
| Ac-36 | $RO-(C_2H_4O)_9-R$ | 2 |
| Ac-37 | $CH_3CH_2-C(CH_2-(OC_2H_4)_l-OR)(CH_2-(OC_2H_4)_m-OR)(CH_2-(OC_2H_4)_n-OR)$ (l + m + n = 3) | 3 |
| Ac-38 | $CH_3CH_2-C(CH_2-(OCOC_6H_{12})_l-OR)(CH_2-(OCOC_6H_{12})_m-OR)(CH_2-(OCOC_6H_{12})_n-OR)$ (l + m + n = 3) | 3 |
| Ac-39 | $RO(CH_2)_2OCONHCH_2-C(CH_3)_2-CH_2CH(CH_3)(CH_2)_2NHCOO(CH_2)_2OR$ | 2 |
| | $RO(CH_2)_2OCONHCH_2CH(CH_3)CH_2-C(CH_3)_2-(CH_2)_2NHCOO(CH_2)_2OR$ (Mixture) | 2 |
| Ac-40 | $(ROCH_2)_3CCH_2OCONH(CH_2)_6NHCOOCH_2C(CH_2OR)_3$ | 6 |
| Ac-41 | $C_2H_5-C(OR)_2-CH_2OCH_2-C(OR)_2-C_2H_5$ | 4 |

In the foregoing, R is represented by the following formula.

$$R = -C(=O)-C(H)=CH_2$$

| Compound No. | Structural Formula | No. of Mc. |
|---|---|---|
| Mc-1 | $CH_3CH_2-C(CH_2OR')_3$ | 3 |
| Mc-2 | $CH_3CH_2-C(CH_2CH(CH_3)OR')_3$ | 3 |
| Mc-3 | $CH_3CH_2-C(CH_2OR')(CH_2CH(CH_3)OR')_3$ | 3 |

-continued

| Compound No. | Structural Formula | No. of Mc. |
|---|---|---|
| Mc-4 | $CH_3CH_2-C(CH_2CHOR')(CH_3)(CH_2OR')_2$ | 3 |
| Mc-5 | $HOCH_2-C(CH_2OR')_3$ | 3 |
| Mc-6 | $HOCH_2-C(CH_2OR')_2-CH_2OCH_2-C(CH_2OR')_2-CH_2OH$ | 4 |
| Mc-7 | $R'OCH_2-C(CH_2OR')_2-CH_2OCH_2-C(CH_2OR')_2-CH_2OR'$ | 6 |
| Mc-8 | $(R'OCH_2)_3-C-CH_2OCH_2-C(R'OC_5H_{10}-C(=O))_2-CH_2OR'$ | 6 |
| Mc-9 | 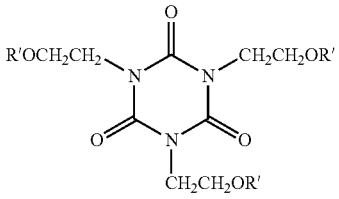 | 3 |
| Mc-10 | $CH_3CH_2C(CH_2OC_3H_6OR')_3$ | 3 |
| Mc-11 | 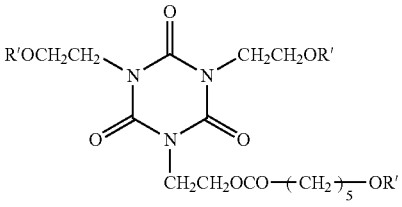 | 3 |
| Mc-12 | $(R'OCH_2)_3C-O-C(CH_2OR')_3$ | 6 |
| Mc-13 | $(R'OCH_2)_3C-CH_2OCH_2-C(H)(CH_2OR')_2$ | 5 |
| Mc-14 | $(R'OCH_2)_3C-CH_2OCH_2-C(CH_3)(CH_2OR')_2$ | 5 |
| Mc-15 | $(R'OCH_2)_3C-CH_2OCH_2-C(CH_2OH)(CH_2OR')_2$ | 5 |
| Mc-16 | $(R'OCH_2)_3C-CH_2OCH_2-C(CH_2OR')(CH_2OH)_2$ | 4 |
| Mc-17 | $(R'OCH_2)_3C-O-C(CH_2OH)(CH_2OR')_2$ | 5 |

-continued
| Compound No. | Structural Formula | No. of Mc. |
|---|---|---|
| Mc-18 | 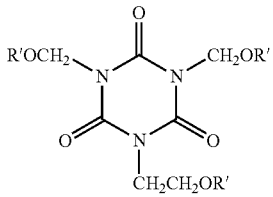 | 3 |
| Mc-19 | $CH_3CH_2C(CH_2CH_2OR')_3$ | 3 |
| Mc-20 | $HOCH_2-C\left(CH_2O-C(=O)CH_2CH_2CH_2CH_2CH_2OR'\right)_3$ | 3 |
| Mc-21 | 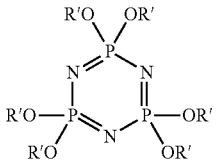 | 6 |
| Mc-22 | 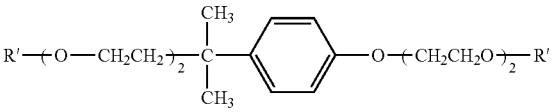 | 2 |
| Mc-23 | 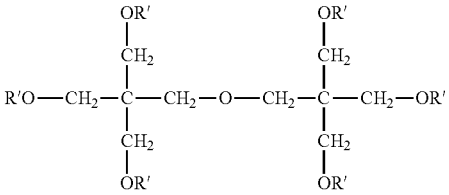 | 6 |
| Mc-24 | 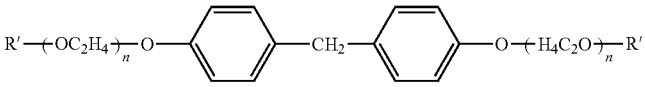 <br> n ≈ 2 | 2 |
| Mc-25 | 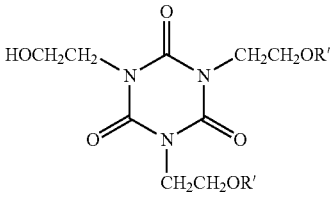 | 2 |
| Mc-26 | $R'-(OC_3H_6)_3-OR'$ | 2 |
| Mc-27 | 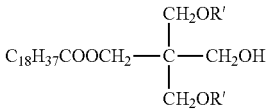 | 2 |
| Mc-28 | 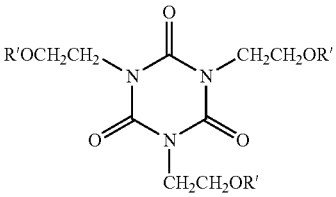 | 3 |

-continued

| Compound No. | Structural Formula | No. of Mc. |
|---|---|---|
| Mc-29 | $[R'-(OC_3H_6)_n-OCH_2)_3-CCH_2CH_3$ (n ≈ 3) | 3 |
| Mc-30 | $\left(CH_3CH_2-C(CH_2OR')_2-CH_2\right)_2-O$ | 4 |
| Mc-31 | $(R'OCH_2)_4-C$ | 4 |
| Mc-32 | $R'O-C_6H_{12}-OR'$ | 2 |
| Mc-33 | $R'O-\left(CH_2CH(CH_3)O\right)_3-R'$ | 2 |
| Mc-34 | $R'O-(C_2H_4O)_2$ 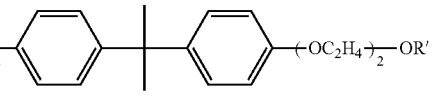 $-(OC_2H_4)_2-OR'$ | 2 |
| Mc-35 | $R'OCH_2$ 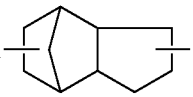 $CH_2OR'$ | 2 |
| Mc-36 | $R'O-(C_2H_4O)_9-R'$ | 2 |
| Mc-37 | $CH_3CH_2-C(CH_2-(OC_2H_4)_l-OR')(CH_2-(OC_2H_4)_m-OR')(CH_2-(OC_2H_4)_n-OR')$ (l + m + n = 3) | 3 |
| Mc-38 | $CH_3CH_2-C(CH_2-(OCOC_6H_{12})_l-OR')(CH_2-(OCOC_6H_{12})_m-OR')(CH_2-(OCOC_6H_{12})_n-OR')$ (l + m + n = 3) | 3 |
| Mc-39 | $R'O(CH_2)_2OCONHCH_2-C(CH_3)_2-CH_2CH(CH_2)_2NHCOO(CH_2)_2OR'$ | 2 |
| | $R'O(CH_2)_2OCONHCH_2CH(CH_3)CH_2-C(CH_3)_2-(CH_2)_2NHCOO(CH_2)_2OR'$ (Mixture) | 2 |
| Mc-40 | $(R'OCH_2)_3CCH_2OCONH(CH_2)_6NHCOOCH_2C(CH_2OR')_3$ | 6 |
| Mc-41 | $C_2H_5-C(OR')_2-CH_2OCH_2-C(OR')_2-C_2H_5$ | 4 |

In the foregoing, R' is represented by the following formula.
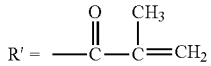
41
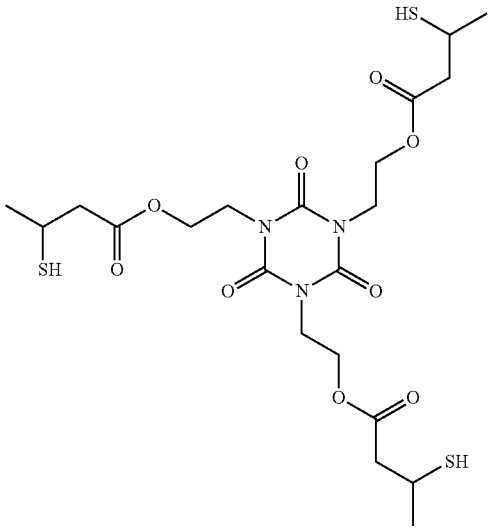
42
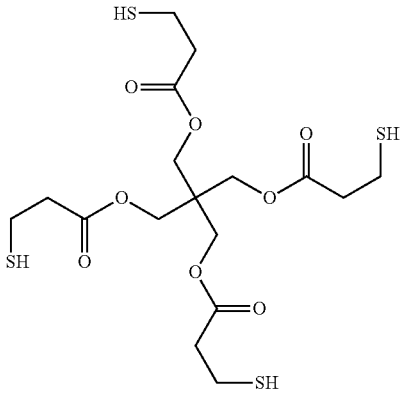
43
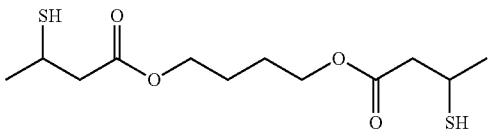
-continued
44
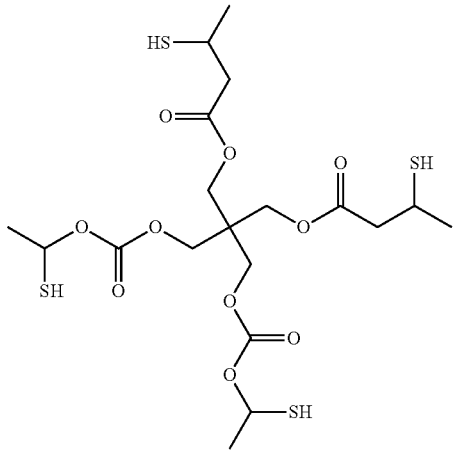
Specific examples of an oxetane compound are shown below but the invention is not limited to these.
45
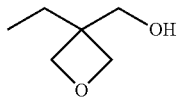
46
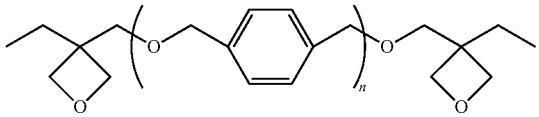
n = 1~3
47
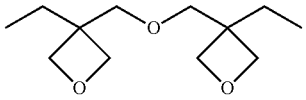
48
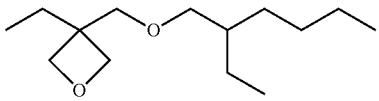
49
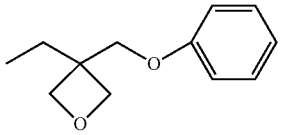
50
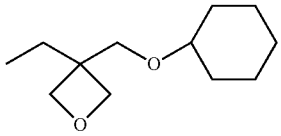

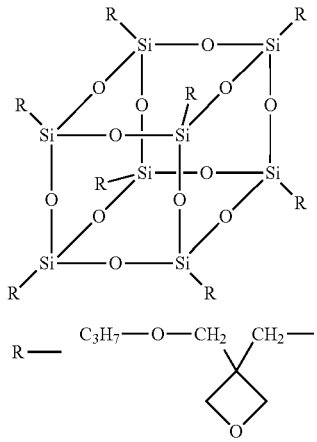

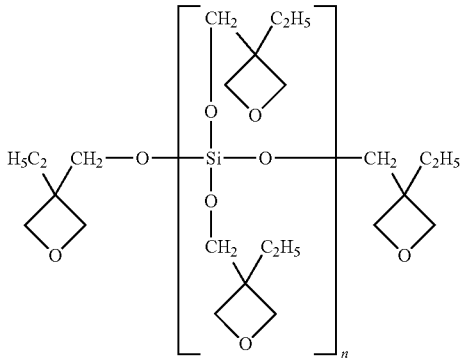

n = 5 (Ave)

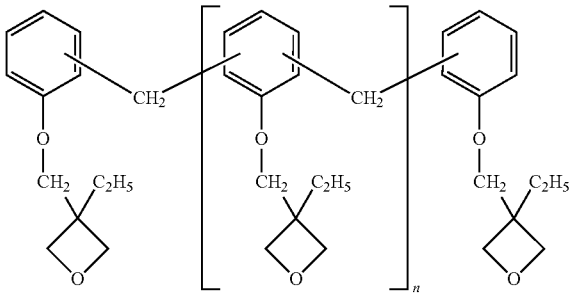

n = 3 (Ave)

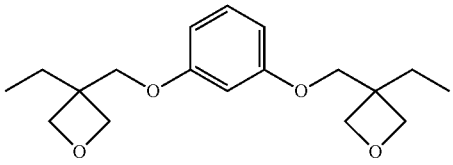

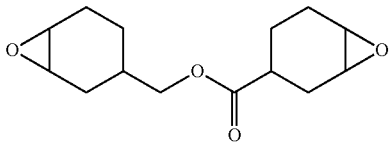

56

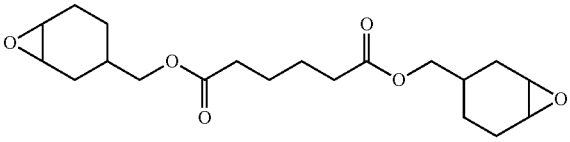

57

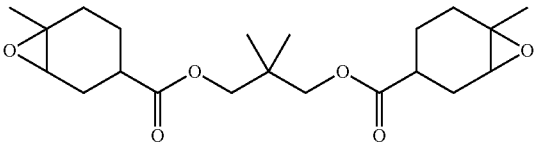

58

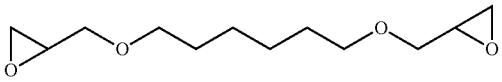

59

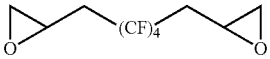

60

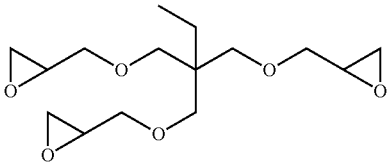

Epoxy compounds include an aromatic epoxy compound, an alicyclic epoxy compound and an aliphatic epoxy compound.

In the invention, the curable compound preferably employs one which contains at least three functional groups (that is, reactive groups). Further, there may be used at least two curable compounds and preferably, at least 50% by mass of the curable compounds is accounted for by compounds containing at least three functional groups.

When reacting the curable compound used in the invention, there may be employed a method of reacting through cleavage by electron beams and a method of reacting through light or heat with addition of a radical-polymerization initiator or a cationic-polymerization initiator. The polymerization initiator may employ either of a photopolymerization initiator and a thermal polymerization initiator. There may be employed a photopolymerization initiator and a thermal polymerization initiator in combination.

A radical polymerization initiator used for a photo-curable compound is preferably a photopolymerization initiator, of which an alkylphenone compound and a phosphine compound are preferred. A compound having a α-hydroxyacetophenone structure or an acylphosphineoxide structure is specifically preferred. Examples of a compounds initiating cationic polymerization include an ionic polymerization initiator, such as $B(C_6F_5)_4^-$, $PF_6^-$, $AsF_6^-$, $SbF_6^-$, or $CF_3SO_3^-$ salt of an aromatic onium compound of a diazonium, ammonium, iodonium, sulfonium or phosphonium; a sulfon compound generating a sulfonic acid, a halogen compound generating a hydrogen halide, and a non-ionic polymerization initiator such as iron arene compound. A nonionic polymerization initiator, such as a sulfone compound generating a sulfonic acid and a halogen compound generating a hydrogen halide is specifically preferred.

Preferred examples of a photopolymerization initiator are shown below.

Examples of α-Aminoacetophenone:

Polymerization initiator 1-1

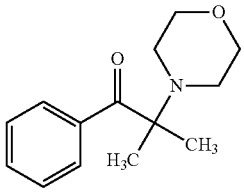

Polymerization initiator 1-2

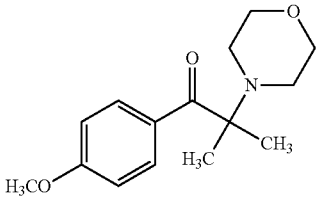

Polymerization initiator 1-3

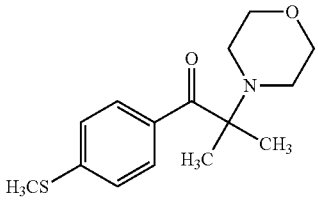

Polymerization initiator 1-4

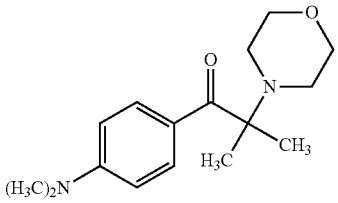

Polymerization initiator 1-5

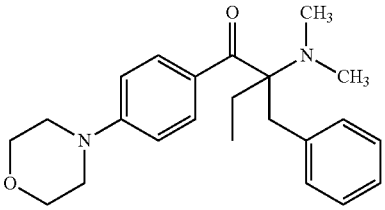

Polymerization initiator 1-6

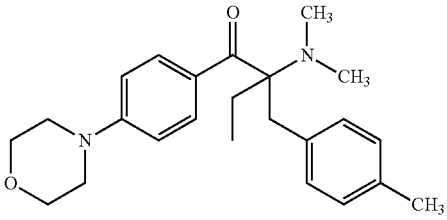

Examples of α-hydroxyacetophenone:

Polymerization initiator 2-1

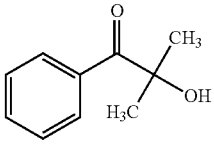

-continued

Polymerization initiator 2-2

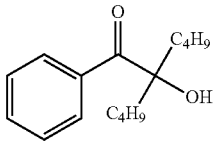

Polymerization initiator 2-3

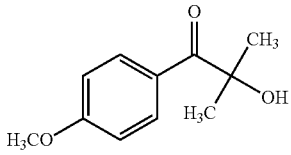

Polymerization initiator 2-4

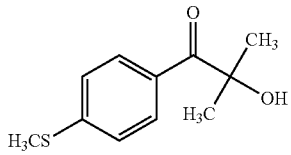

Polymerization initiator 2-5

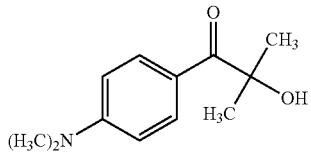

Polymerization initiator 2-6

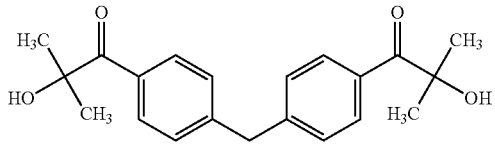

Examples of acyiphosphineoxide compound:

Polymerization initiator 3-1

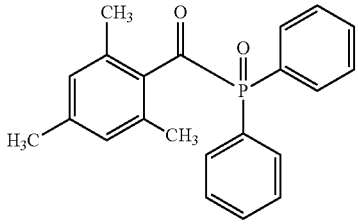

Polymerization initiator 3-2

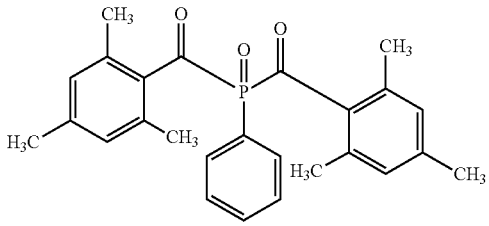

Examples of Other Polymerization Initiator:

Polymerization initiator 4-1

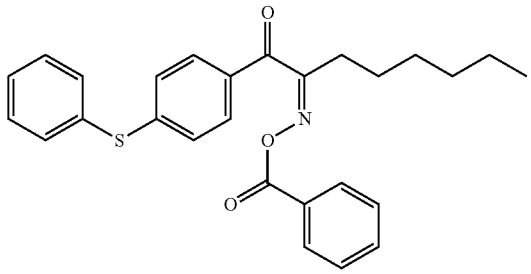

Polymerization initiator 4-2

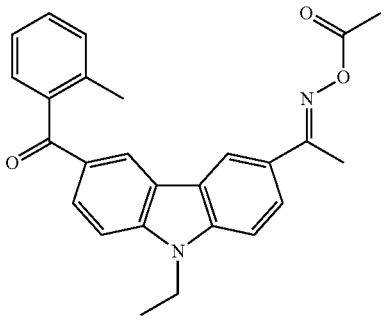

Polymerization initiator 4-3

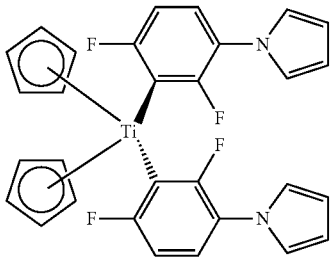

Polymerization initiator 5-1

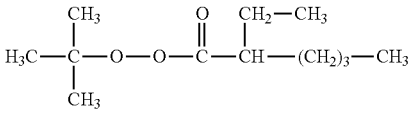

Nonionic Polymerization Initiator:

Polymerization initiator 6-1

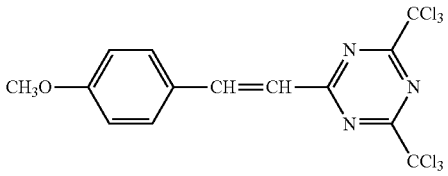

Polymerization initiator 6-2

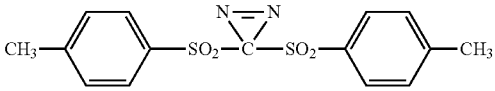

-continued

Polymerization initiator 6-3

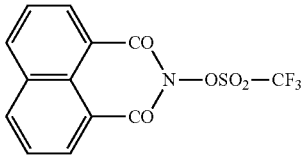

Polymerization initiator 6-4

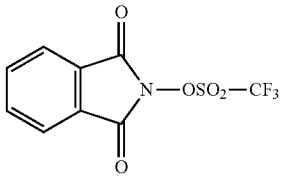

Polymerization initiator 6-5

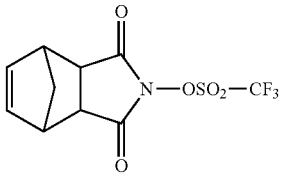

Polymerization initiator 6-6

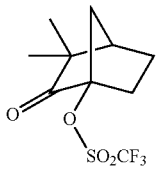

Ionic Polymerization Initiator:

Polymerization initiator 7-1

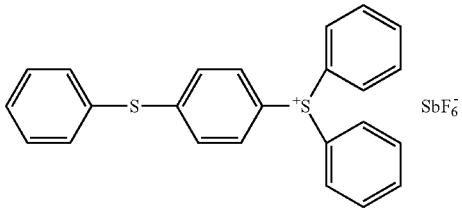

Polymerization initiator 7-2

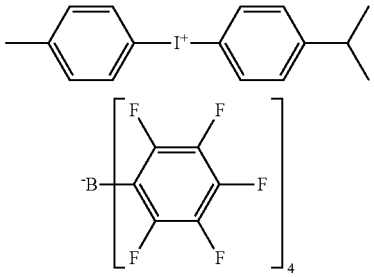

A protective layer of a photo-curable resin is formed in such a manner that a coating solution of a protective layer (composition containing metal oxide particles formed by a plasma method and a curable compound) is coated on a photosensitive layer and primarily dried to the extent of fluidity of the coated layer being lost, followed by exposure to ultraviolet rays to cure the protective layer, and is secondarily dried to control the volatile material quantity.

A device of irradiating ultraviolet rays may employ a commonly known device used to cure an ultraviolet-curable resin.

The dose (mJ/cm$^2$) of ultraviolet rays necessary to cure a resin is controlled preferably by the exposure intensity and exposure time of ultraviolet rays.

Thermal polymerization initiators include a ketone peroxide compound, a peroxyketal compound, a hydroperoxide compound, a dialkylperoxide compound, a diacylperoxide compound, a peroxydicarbonate compound, and a peroxyester compound. These thermal polymerization initiators are disclosed in product catalogs of companies.

On the invention, similarly to the foregoing photopolymerization initiators, a thermal polymerization initiator is mixed with a mixture of the composition containing metal oxide particles formed by a plasma method and a curable compound to prepare a coating solution of a protective layer, and the coating solution is coated on a photosensitive layer and dried with heating to form a protective layer related to the invention. The thermal polymerization initiator may employ radical polymerization initiators, as described above.

In the coating method of a protective layer, an immersion coating method in which the whole of a photoreceptor is immersed in a coating solution of a protective layer promotes diffusion of a polymerization initiator to the lower layer. To reduce solution of a photosensitive layer below the protective layer as little as possible, it is preferred to employ a coating method such as a quantity controlling type coating (typically, a circular slide hopper type). The foregoing circular quantity control coating is described in, for example, JP 50-189061A.

The foregoing polymerization initiators may be used alone or in combination. The content of a polymerization initiator is preferably from 0.1 to 20 parts by mass per 100 parts of an acryl compound, and more preferably from 0.5 to 10 parts by mass.

In the invention, the protective layer may contain various kinds of charge transport materials or antioxidants, or lubricant particles. For instance, there may be added fluorine-containing resin particles. It is preferred to choose, as fluorine-containing resin particles, one or more of a tetrafluoroethylene resin, a trifluorochloroethylene resin, a hexafluorochloroethylenepropylene resin, a fluorovinyl resin, a fluorovinylidene resin, a difluorodichloroethylene resin and their copolymers, and a tetrafluoroethylene resin or a fluorovinylidene resin is preferred. The proportion of lubricant particles in a protective layer is preferably from 5 to 70 parts by mass of 100 parts by mass of acryl resin, and more preferably from 10 to 60 parts by mass. The particle size of lubricant particles is preferably from 0.01 to 1 μm in tams of average primary particle diameter, and more preferably from 0.05 to 0.5 μm. The molecular weight of a resin is appropriately chosen and is not specifically limited.

Examples of a solvent used to form a protective layer include methanol, ethanol, n-propyl alcohol, iso-propyl alcohol, n-butanol, t-butanol, sec-butanol, benzyl alcohol, toluene, xylene, methylene chloride, methyl ethyl ketone, cyclohexane, ethyl acetate, methyl cellosolve, ethyl cellosolve, tetrahydrofuran, 1-dioxane, 1,3-dioxolane, pyridine and diethylamine but are not limited to these.

In the invention, it is preferred to expose the protective layer to actinic rays after being coated and naturally or thermally dried.

Similarly to an intermediate layer or a photosensitive layer, coating methods of a protective layer include methods known in the art, such as a dip coating method, a spray coating method, a blade coating method, a beam coating method, and a slide hopper method.

In the photoreceptor of the invention, it is preferred to expose a coated layer to actinic rays to generate radicals to perform polymerization and to form cross-linking bonds through intermolecular and intramolecular cross-linking reaction, and thereby forming a cured resin. Such actinic rays are preferably an ultraviolet rays or an electron beam.

The light source for ultraviolet rays is not specifically limited and may employ any light source capable of emitting ultraviolet rays. Examples of such a light source include a low pressure mercury lamp, a medium pressure mercury lamp, a high pressure mercury lamp, a carbon arc lamp, a metal halide lamp, xenon lamp, and flash (pulse) xenon. Exposure conditions are different, depending of the individual lamp. The exposure amount of an actinic ray is usually from 5 to 500 mJ/cm$^2$, and preferably from 5 to 100 mJ/cm$^2$. The power of a lamp is preferably from 0.1 to 5 kW, and more preferably from 0.5 to 3 kW.

The electron beam source does not specifically restrict an electron beam exposure apparatus and a curtain beam system which is available at a relatively low price and can obtain a large power is generally employed as an electron beam accelerator used for exposure to an electron beam. The acceleration voltage at the time of exposure to an electron beam is preferably from 100 to 300 kV. The absorption dose is preferably from 0.5 to 10 Mrad.

The exposure time to obtain the required exposure amount of an actinic ray is preferably from 0.1 sec. to 10 min and more preferably from 0.1 sec. to 5 min. in terms of work efficiency.

An ultraviolet ray is easily usable and preferred as the actinic ray.

The photoreceptor of the invention may be dried before, after or during exposed to an actinic ray and timing of drying is appropriately chosen by the combination of these.

Drying conditions can be chosen depending of the kind of solvent or layer thickness. The drying temperature is preferably from room temperature to 180° C., and more preferably from 80 to 140° C. The drying time is preferably from 1 to 200 min., and more preferably from 5 to 100 min.

The thickness of the protective layer is preferably from 0.2 to 10 μm and more preferably from 0.5 to 6 μm.

In the following, there will be described the constitution of the organic photoreceptor of the invention, except for the foregoing protective layer.

In the invention, the organic photoreceptor refers to an electrophotographic photoreceptor comprised of an organic compound having at least one of a charge generation function and a charge transport function which are indispensable for constitution of an electrophotographic photoreceptor and include all of organic photoreceptors known in the art, such as a photoreceptor constituted of an organic charge generation material or an organic charge transport material known in the art or a photoreceptor constituted of a polymeric complex having a charge generation function and a charge transport function.

The organic photoreceptor of the invention comprises, on an electrically conductive support, at least a photosensitive layer and, further thereon, a protective layer, as described above. Specifically, the following layer structure is exemplified.

(1) A layer structure comprising on a conductive support an intermediate layer, a charge generation layer and a charge transport layer as a photosensitive layer and a protective layer, layer in the sequence set forth; and (2) A layer structure comprising on a conductive support an intermediate layer, a single layer containing a charge generation material and a charge transport material as a photosensitive layer, and a protective layer in the sequence set forth.

The layer structure of the organic photoreceptor of the invention will be described particularly with respect to the foregoing (1).

Conductive Support:

A support usable in the invention may be any electrically conductive one and examples thereof include a drum or sheet of aluminum, copper, chromium, nickel, zinc, or stainless steel; a metal foil such as aluminum or copper, laminated with a plastic film; a deposited metal such as aluminum, indium oxide or tin oxide on a plastic film; a metal, plastic film or paper in which a conductive substance is coated singly or together with a binder to provide a conductive layer.

Intermediate Layer:

In the invention, there may be provided an intermediate layer having a barrier function and an adhesion function between a conductive layer and a photosensitive layer.

An intermediate layer may be formed by dissolving, in a solvent, a binder resin such as casein, polyvinyl alcohol, nitrocellulose, ethylene-acrylic acid copolymer, polyamide, polyurethane or gelatin, followed by dip-coating thereof. Of these resins, alcohol-soluble polyimide resin is preferred.

There may be incorporated various kinds of electrically conductive particles or metal oxides. Examples thereof include metal oxides such as alumina, zinc oxide, titanium oxide, tin oxide, antimony oxide, indium oxide and bismuth oxide; and ultra-fine particles of tin-doped indium, antimony-doped tin oxide and zirconium oxide.

These metal oxides may be used singly or in combination. When two or more metal oxides are used in combination, they may be in the form of a solid solution or being fused. The average particle size of such a metal oxide is preferably not more than 0.3 μm, and more preferably not more than 0.1 μm.

A solvent used for an intermediate layer preferably is one capable of dispersing inorganic particles and dissolving the polyamide resin. Specifically, alcohols with 2-4 carbons, such as ethanol, n-propyl alcohol, iso-propyl alcohol, n-butanol, t-butanol, or sec-butanol are preferred, which are superior in solution and coating performance of a polyamide resin. Auxiliary solvents which are used in combination with the foregoing solvents and effective to achieve enhanced dispersibility, include methanol, benzyl alcohol, toluene, methylene chloride, cyclohexane, and tetrahydrofuran.

The binder resin concentration is appropriately chosen to meet the thickness or production speed of the intermediate layer.

When dispersing inorganic particles in a binder resin, the mixing ratio of inorganic particles to a binder resin is preferably 20 to 400 parts by mass, based on 100 parts of a binder resin, and more preferably 50 to 200 parts by mass.

Means for dispersing inorganic particles include, for example, an ultrasonic dispersing machine, a ball mill, a sand grinder, a homo-mixer and the like, but are not limited to these.

A drying method of an intermediate layer is appropriately chosen in accordance with the kind of a solvent or layer thickness, but heat drying is preferred.

The thickness of an intermediate layer is preferably from 0.1 to 15 μm, and more preferably from 0.3 to 10 μm.

Charge Generation Layer:

A charge generation layer used in the invention a charge generation material and a binder, and preferably, the charge generation material dispersed in a binder resin solution is coated to form a charge generation layer.

Examples of a charge generation material include an azo pigment, such as Sudan Red or Dian Blue, a quinine pigment such as pyrenequinone or anthanthrone, a quinocyanine pigment, a perylene pigment, an indigo pigment such as indigo or thioindigo, and a phthalocyanine pigment, but are not limited to these. Such a charge generation material is used alone or in the form of being dispersed in a resin known in the art.

A binder resin of the charge generation layer may employ a resin known in the art and examples thereof include a polystyrene resin, a polyethylene resin, a polypropylene resin, an acryl resin, a methacryl resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin a melamine resin, and a copolymer resin comprising at least two of the foregoing resins (for example, vinyl chloride/vinyl acetate copolymer resin, vinyl chloride/vinyl acetate/maleic acid anhydride copolymer resin), and polyvinyl carbazole resin, but are not limited to these.

Preferably, a charge generation layer is formed in the manner that a charge generation material is dispersed in a solution of a binder resin dissolved in a solvent to prepare a coating solution, the coating solution is coated at a given thickness by a coating machine and the coated layer is dried.

Examples of a solvent to dissolve the binder resin used for a charge generation layer include toluene, xylene, methylene chloride, 1,2-dichloroethane, methyl ethyl ketone, cyclohexane, ethyl acetate, methanol, ethanol, propanol, butanol, methyl cellosolve, ethyl cellosolve, tetrahydrofuran, 1-dioxane, 1,3-dioxorane, pyridine and diethylamine, but are not limited to these.

The dispersing means for a charge generation material include, for example, an ultrasonic dispersing machine, a ball mill, a sand grinder and a homo-mixer, but is not limited to these.

The mixing ratio of charge generation material to binder resin is preferably from 1 to 600 parts by mass of a charge generation material, based on 100 parts by mass of a binder resin, and more preferably from 50 to 500 parts by mass. The thickness of the charge generation layer, depending of characteristics of the charge generation layer, characteristics of a binder resin and a mixing ratio, is preferably from 0.01 to 5 μm, and more preferably from 0.05 to 3 μm. Filtration of a coating solution of a charge generation layer before being coated filters out foreign matter or an aggregate to prevent image defects. A pigment, as described above may be deposited through vacuum deposition to form a charge generation layer.

Charge Transport Layer:

A charge transport layer used in the invention a charge transport material and a binder, and preferably, the charge transport material dispersed in a binder resin solution is coated to form a charge transport layer.

Examples of a charge transport material include a carbazole derivative, an oxazole derivative, an oxadiazole derivative, a thiazole derivative, a thiadiazole derivative, a triazole derivative, an imidazole derivative, an imidazolone derivative, an imidazolidine derivative, a bis-imidazolidine derivative, a styryl derivative, a hydrazone compound, a pyrazoline compound, an oxazolone derivative, a benzimidazole derivative, a quinazoline derivative, a benzofuran derivative, an acridine derivative, a phenazine derivative, an aminostilbene derivative, a triazoleamine derivative, a phenylenediamine derivative, a stilbene derivative, a benzidine derivative, poly-N-vinylcarbazole, poly-1-vinylpyrrene, poly-9-vinylanthracene, and a triphenylamine derivative. These may be used in combination.

A binder resin used for a charge transport layer can employ a resin known in the art. Examples thereof include a polycarbonate resin, a polyacrylate resin, a polyester resin, a polystyrene resin, a styrene-acrylonitrile copolymer resin, a polymethacrylic acid ester resin and a styrene-methacrylic acid ester copolymer resin, and of these, a polycarbonate resin is preferred. Further, BPA, BPZ, dimethyl-BPA, and BPA-dimethyl-BPA copolymer are preferred in terms of cracking resistance, abrasion resistance and electrostatic-charging characteristic.

Preferably, the charge transport layer is formed in the manner that a charge transport material and a binder resin are dissolved in a solvent to prepare a coating solution, the coating solution is coated at a given thickness with a coating machine and the coated layer is dried.

Examples of a solvent used for the solution of the foregoing binder and a charge transport material include toluene, xylene, methylene chloride, 1,2-dichloroethane, methyl ethyl ketone, cyclohexane, ethyl acetate, methanol, ethanol, propanol, butanol, methyl cellosolve, ethyl cellosolve, tetrahydrofuran, 1-dioxane, 1,3-dioxorane, pyridine and diethylamine, but are not limited to these.

The mixing ratio of binder resin to charge transport material is preferably from 10 to 500 parts by mass of the charge generation material, based on 100 parts by mass of the binder resin, and more preferably from 20 to 100 parts by mass.

The thickness of a charge transport layer, depending of the characteristics of the charge transport layer, characteristics of the binder resin and mixing ratio, is preferably from 5 to 40 μm, and more preferably from 10 to 30 μm.

An antioxidant, an electron conducting agent, a stabilizer or the like may be incorporated to the charge transport layer. There are preferred an antioxidant described in Japanese Patent Application No. 11-200135, an electron conducting agent described in JP 50-137543A or JP 58-076483A.

Next, there will be described an image forming apparatus using the organic photoreceptor of the invention.

An image forming apparatus 1, as illustrated in FIG. 1, is a digital type image forming apparatus, which comprises an image reading section A, an image processing section B, an image forming section C and a transfer paper conveyance section D as a means for conveying transfer paper.

An automatic manuscript feeder to automatically convey a manuscript is provided above the image reading section. A manuscript placed on a manuscript-setting table 11 is conveyed sheet by sheet by a manuscript-conveying roller 12 and read at a reading position 13*a* to read images. A manuscript having finished manuscript reading is discharged onto a manuscript discharge tray 14 by the manuscript-conveying roller 12.

On the other hand, the image of a manuscript placed on a platen glass 13 is read by a reading action, at a rate of v, of a first minor unit 15 constituted of a lighting lamp and a first mirror, followed by conveyance at a rate of v/2 toward a second mirror unit 16 constituted of a second mirror and a third mirror which are disposed in a V-form.

The thus read image is formed through a projection lens 17 onto the acceptance surface of an image sensor CCD as a line sensor. Aligned optical images formed on the image sensor CCD are sequentially photo-electrically converted to electric signals (luminance signals), then subjected A/D conversion and further subjected to treatments such as density conversion and a filtering treatment in the image processing section B, thereafter, the image data is temporarily stored in memory.

In the image forming section C, a drum-form photoreceptor 21 as an image bearing body and in its surrounding, a charger 22 (charging step) to allow the photoreceptor 21 to be charged, a potential sensor 220 to detect the surface potential of the charged photoreceptor, a developing device 23 (development step), a transfer conveyance belt device 45 as a transfer means (the transfer step), a cleaning device 26 (cleaning step) for the photoreceptor 21 and a pre-charge lamp (PCL) 27 as a photo-neutralizer (photo-neutralizing step) are disposed in the order to carry out the respective operations. A reflection density detector 222 to measure the reflection density of a patch image developed on the photoreceptor 21 is provided downstream from the developing means 23. The photoreceptor 21, which employs an organic photoreceptor relating to the invention, is rotatably driven clockwise, as indicated.

After having been uniformly charged by the charger 22, the rotating photoreceptor 21 is imagewise exposed through an exposure optical system as an imagewise exposure means 30 (imagewise exposure step), based on image signals called up from the memory of the image processing section B. The exposure optical system as an imagewise exposure means 30 of a writing means employs a laser diode, not shown in the drawing, as an emission light source and its light path is bent by a reflecting mirror 32 via a rotating polygon mirror 31, a f□ lens 34 and a cylindrical lens 35 to per form main scanning. Imagewise exposure is conducted at the position of Ao to the photoreceptor 21 and an electrostatic latent image is formed by rotation of the photoreceptor (sub-scanning). In one of the embodiments, the character portion is exposed to form an electrostatic latent image.

In the image forming apparatus of the invention, a semiconductor laser at a 350-800 nm oscillating wavelength or a light-emitting diode is preferably used as a light source for imagewise exposure. Using such a light source for imagewise exposure, an exposure dot diameter in the main scanning direction of writing can be narrowed to 10-100 □m and digital exposure can be performed onto an organic photoreceptor to realize an electrophotographic image exhibiting a high resolution of 400 to 2500 dpi (dpi: dot number per 2.54 cm). The exposure dot diameter refers to an exposure beam length (Ld, measured at the position of the maximum length) along the main-scanning direction in the region exhibiting an exposure beam intensity of not less than $1/e^2$ of the peak intensity.

Utilized light beams include a scanning optical system using a semiconductor laser and a solid scanner of LED, while the light intensity distribution includes a Gaussian distribution and a Lorentz distribution, but the exposure dot diameter is defined as a region of not less than $1/e^2$ of the respective peak intensities.

An electrostatic latent image on the photoreceptor 21 is reversely developed by the developing device 23 to form a visible toner image on the surface of the photoreceptor 21. In the image forming method of the invention, the developer used in the developing device preferably is a polymerization toner. The combined use of a polymerization toner which is uniform in shape and particle size distribution and the organic photoreceptor of the invention can obtain electrophotographic images exhibiting superior sharpness.

Toner

A latent image formed on the organic photoreceptor of the invention is developed to form a toner image. A toner used for development may be a pulverization toner or a polymerization toner, but a polymerization toner prepared by a polymerization process is preferred as a toner related to the invention in terms of a stable particle size distribution being achieved.

The polymerization toner means a toner formed by a process of formation of a binder resin used for a toner and following chemical treatments. Specifically, it means a toner formed through a polymerization reaction such as suspension polymerization or emulsion polymerization, followed by coagulation and fusion of particles.

The volume average particle size of a toner, that is, 50% volume particle size (Dv50) is preferably from 2 to 9 m, and more preferably from 3 to 7 μm. This particle size range results in enhanced resolution. Further, the combination with the foregoing range can reduce the content of minute toner particles, leading to improved dot image reproducibility, superior sharpness and stable image formation.

Developer:

A developer relating to the invention may be a single component developer or two component developer.

A single component developer includes a non-magnetic single component developer and a magnetic single component developer containing 0.1-0.5 μm magnetic particles, each of which is usable.

A toner may be mixed with a carrier, which is usable as a two-component developer. In that case, there are usable commonly known materials, such as metals of iron, ferrite, magnetite or the like and alloys of these metals and a metal of aluminum or lead. Of these, ferrite particles are specifically preferred. The foregoing magnetic particles preferably are those having a volume average particle size of 15 to 100 μm (more preferably, 25 to 80 μm).

The volume average particle size of a carrier can be measured by laser refraction type particle size analyzer, HELOS (produced by SYMPATEC Co.).

A carrier is preferably one which covered with a resin or a resin dispersion type one in which magnetic particles are dispersed in a resin. A resin used for coating is not specifically limited but examples thereof include a olefin rein, styrene resin, styrene-acryl resin, silicone resin, ester resin and fluorine-containing resin. A resin constituting a resin dispersion type carrier is not specifically limited but employs commonly known one, including, for example, styrene-acryl resin, polyester resin, fluororesin, a phenol resin and the like.

In the transfer paper conveyance section D, paper supplying units 41(A), 41(B) and 41(C) as a transfer paper housing means for housing transfer paper P differing in size are provided below the image forming unit and a paper hand-feeding unit 42 is laterally provided, and transfer paper P chosen from either one of them is fed by a guide roller 43 along a conveyance route 40. After the fed paper P is temporarily stopped by paired paper feeding resist rollers 44 to make correction of tilt and bias of the transfer paper P, paper feeding is again started and the paper is guided to the conveyance route 40, a transfer pre-roller 43*a*, a paper feeding route 46 and entrance guide plate 47. A toner image on the photoreceptor 21 is transferred onto the transfer paper P at the position of Bo, while being conveyed with being put on a transfer conveyance belt 454 of a transfer conveyance belt device 45 by a transfer pole 24 and a separation pole 25. The transfer paper P is separated from the surface of the photoreceptor 21 and conveyed to a fixing device 50 by the transfer conveyance belt 45.

The fixing device 50 has a fixing roller 51 and a pressure roller 52 and allows the transfer paper P to pass between the fixing roller 51 and the pressure roller 52 to fix the toner by heating and pressure. The transfer paper P which has completed fixing of the toner image is discharged onto a paper discharge tray 64.

Image formation on one side of transfer paper is described above and in the case of two-sided copying, a paper discharge switching member 170 is switched over, and a transfer paper guide section 177 is opened and the transfer paper P is conveyed in the direction of the dashed arrow. Further, the transfer paper P is conveyed downward by a conveyance mechanism 178 and switched back in a transfer paper reverse section 179, and the rear end of the transfer paper P becomes the top portion and is conveyed to the inside of a paper feed unit 130 for two-sided copying.

The transfer paper P is moved along a conveyance guide 131 in the paper feeding direction, transfer paper P is again fed by a paper feed roller 132 and guided into the transfer route 40. The transfer paper P is again conveyed toward the direction of the photoreceptor 21 and a toner is transferred onto the back surface of the transfer paper P, fixed by the fixing device 50 and discharged onto the paper discharge tray 64.

In an image forming apparatus relating to the invention, constituent elements such as a photoreceptor, a developing device and a cleaning device may be integrated as a process cartridge and this unit may be freely detachable. At least one of an electrostatic charger, an image exposure device, a transfer or separation device and a cleaning device is integrated with a photoreceptor to form a process cartridge as a single detachable unit from the apparatus body and may be detachable by using a guide means such as rails in the apparatus body.

Figure 2:
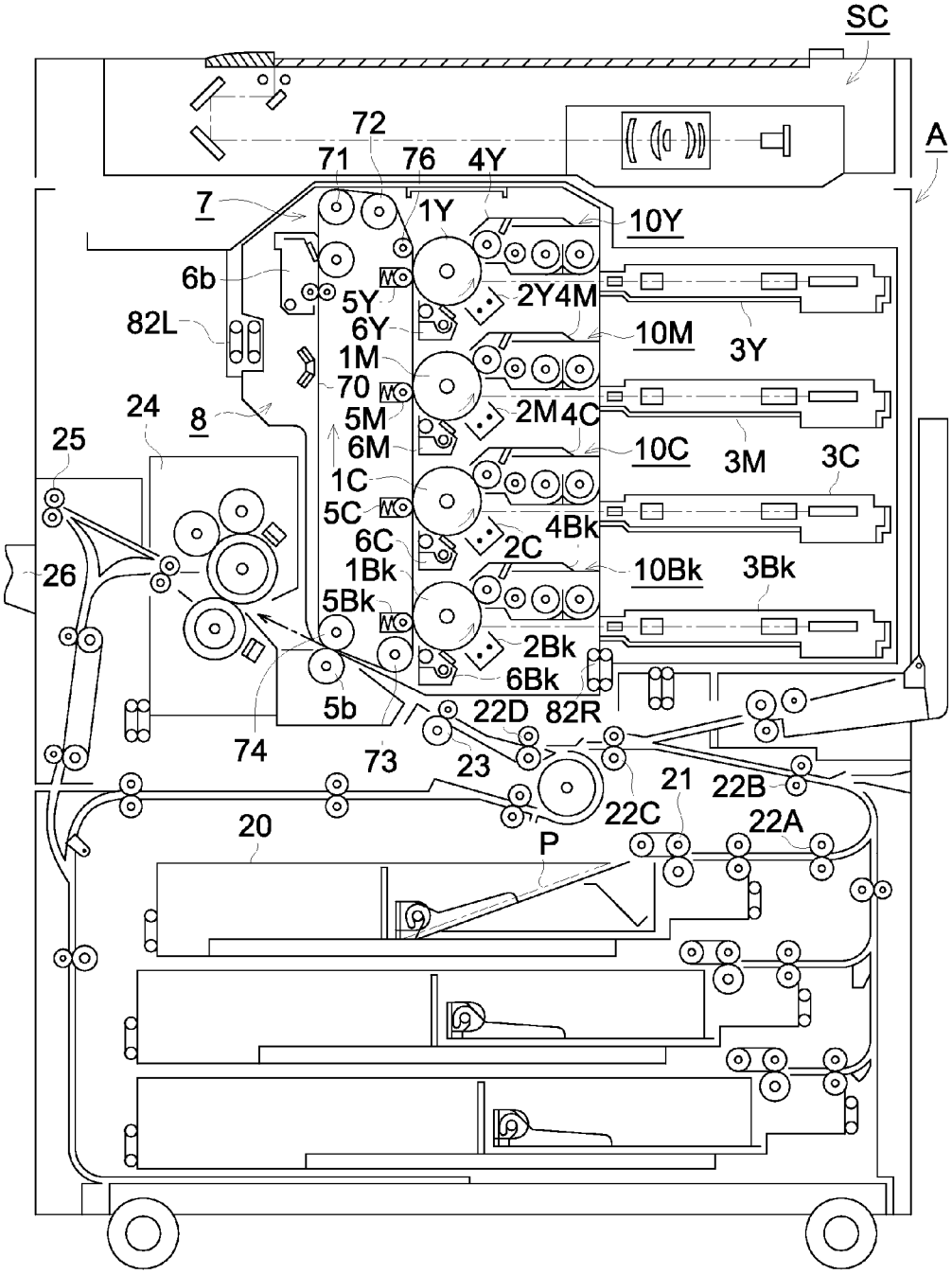
FIG. 2 illustrates a sectional view of a color image forming apparatus relating to one embodiment of the invention.

FIG. 2 illustrates a sectional view of a color image forming apparatus showing one of the embodiments of the invention.

This image forming apparatus is called a tandem color image forming apparatus, which is, as a main constitution, comprised of four image forming sections (image forming units) 10Y, 10M, 10C and 10Bk; an intermediate transfer material unit 7 of an endless belt form, a paper feeding and conveying means 21 and as a fixing means 24. Original image reading device SC is disposed in the upper section of image forming apparatus body A.

Image forming section 10Y to form a yellow image comprises a drum-form photoreceptor 1Y as the first photoreceptor; an electrostatic-charging means 2Y (electrostatic-charging step), an exposure means 3Y (exposure step), a developing means 4Y (developing step), a primary transfer roller 5Y (primary transfer step) as a primary transfer means; and a cleaning means 6Y, which are disposed around the photoreceptor 1Y.

An image forming section 10M to form a magenta image comprises a drum-form photoreceptor 1M as the second photoreceptor; an electrostatic-charging means 2M, an exposure means 3M and a developing means 4M, a primary transfer roller 5M as a primary transfer means; and a cleaning means 6M, which are disposed around the photoreceptor 1M.

An image forming section 10C to form a cyan image formed on the respective photoreceptors comprises a drum-form photoreceptor 1C as the third photoreceptor, an electrostatic-charging means 2Y, an exposure means 3C, a developing means 4C, a primary transfer roller 5C as a primary transfer means and a cleaning means 6C, all of which are disposed around the photoreceptor 1C.

An image forming section 10Bk to form a black image formed on the respective photoreceptors comprises a drum-form photoreceptor 1Bk as the fourth photoreceptor; an electrostatic-charging means 2Bk, an exposure means 3Bk, a developing means 4Bk, a primary transfer roller 5Bk as a primary transfer means and a cleaning means 6Bk, which are disposed around the photoreceptor 1Bk.

The foregoing four image forming units 10Y, 10M, 10C and 10Bk are comprised of centrally-located photoreceptor drums 1Y, 1M, 1C and 1Bk; rotating electrostatic-charging means 2Y, 2M, 2C and 2Bk; imagewise exposure means 3Y, 3M, 3C and 3Bk; rotating developing means 4Y, 4M, 4C and 4Bk; and cleaning means 5Y, 5M, 5C and 5Bk for cleaning the photoreceptor drums 1Y, 1M, 1C and 1Bk.

The image forming units 10Y, 10M, 10C and 10Bk are different in color of toner images formed in the respective photoreceptors 1Y, 1M, 1C and 1Bk but are the same in constitution, and, for example, the image forming unit 10Y will be described below.

The image forming unit 10Y disposes, around the photoreceptor 1Y, an electrostatic-charging means 2Y (hereinafter, also denoted as a charging means 2Y or a charger 2Y), an exposure means 3Y, developing means (developing step) 4Y, and a cleaning means 5Y (also denoted as a cleaning blade 5Y, and forming a yellow (Y) toner image on the photoreceptor 1Y. In this embodiment, of the image forming unit 10Y, at least the photoreceptor unit 1Y, the charging means 2Y, the developing means 4Y and the cleaning means 5Y are integrally provided.

The charging means 2Y is a means for providing a uniform electric potential onto the photoreceptor drum 1Y. In the embodiment, a corona discharge type charger 2Y is used for the photoreceptor 1Y.

The imagewise exposure means 3Y is a mean which exposes, based on (yellow) image signals, the photoreceptor drum 1Y having a uniform potential given by the charger 2Y to form an electrostatic latent image corresponding to the yellow image. As the exposure means 3Y is used one composed of an LED arranging emission elements arrayed in the axial direction of the photoreceptor drum 1Y and an imaging device (trade name: SELFOC Lens), or a laser optical system.

In the image forming apparatus relating to the invention, the above-described photoreceptor and constituting elements such as a developing device and a cleaning device may be integrally combined as a process cartridge (image forming unit), which may be freely detachable from the apparatus body. Further, at least one of a charger, an exposure device, a developing device, a transfer or separating device and a cleaning device is integrally supported together with a photoreceptor to form a process cartridge as a single image forming unit which is detachable from the apparatus body by using a guide means such as a rail of the apparatus body.

Intermediate transfer unit 7 of an endless belt form is turned by plural rollers and has intermediate transfer material 70 as the second image carrier of an endless belt form, while being pivotably supported.

The individual color images formed in image forming sections 10Y, 10M, 10C and 10Bk are successively transferred onto the moving intermediate transfer material (70) of an endless belt form by primary transfer rollers 5Y, 5M, 5C and 5Bk, respectively, to form a composite color image. Recording member P of paper or the like, as a final transfer material housed in a paper feed cassette 20, is fed by paper feed and a conveyance means 21 and conveyed to a secondary transfer roller 5*b* through plural intermediate rollers 22A, 22B, 22C and 22D and a resist roller 23, and color images are secondarily transferred together on the recording member P. The color image-transferred recording member (P) is fixed by a heat-roll type fixing device 24, nipped by a paper discharge roller 25 and put onto a paper discharge tray outside a machine. Herein, a transfer support of a toner image formed on the photoreceptor, such as an intermediate transfer body and a transfer material collectively means a transfer medium.

After a color image is transferred onto a transfer material P by a secondary transfer roller 5*b* as a secondary transfer means, an intermediate transfer material 70 of an endless belt form which separated the transfer material P removes any residual toner by cleaning means 6*b*.

During the image forming process, the primary transfer roller 5Bk is always in contact with the photoreceptor 1Bk. Other primary transfer rollers 5Y, 5M and 5C are each in contact with the respectively corresponding photoreceptors 1Y, 1M and 1C only when forming a color image.

The secondary transfer roller 5*b* is in contact with the intermediate transfer material 70 of an endless belt form only when the transfer material P passes through to perform secondary transfer.

A housing 8, which can be pulled out from the apparatus body A through supporting rails 82L and 82R, is comprised of image forming sections 10Y, 10M, 10C and 10Bk and the endless belt intermediate transfer unit 7.

Image forming sections 10Y, 10M, 10C and 10Bk are aligned vertically. The endless belt intermediate transfer material unit 7 is disposed on the left side of photoreceptors 1Y, 1M, 1C and 1Bk, as indicated in FIG. 2. The intermediate transfer material unit 7 comprises the endless belt intermediate transfer material 70 which can be turned via rollers 71, 72, 73 and 74, primary transfer rollers 5Y, 5M, 5C and 5Bk and cleaning means 6*b*.

Figure 3:
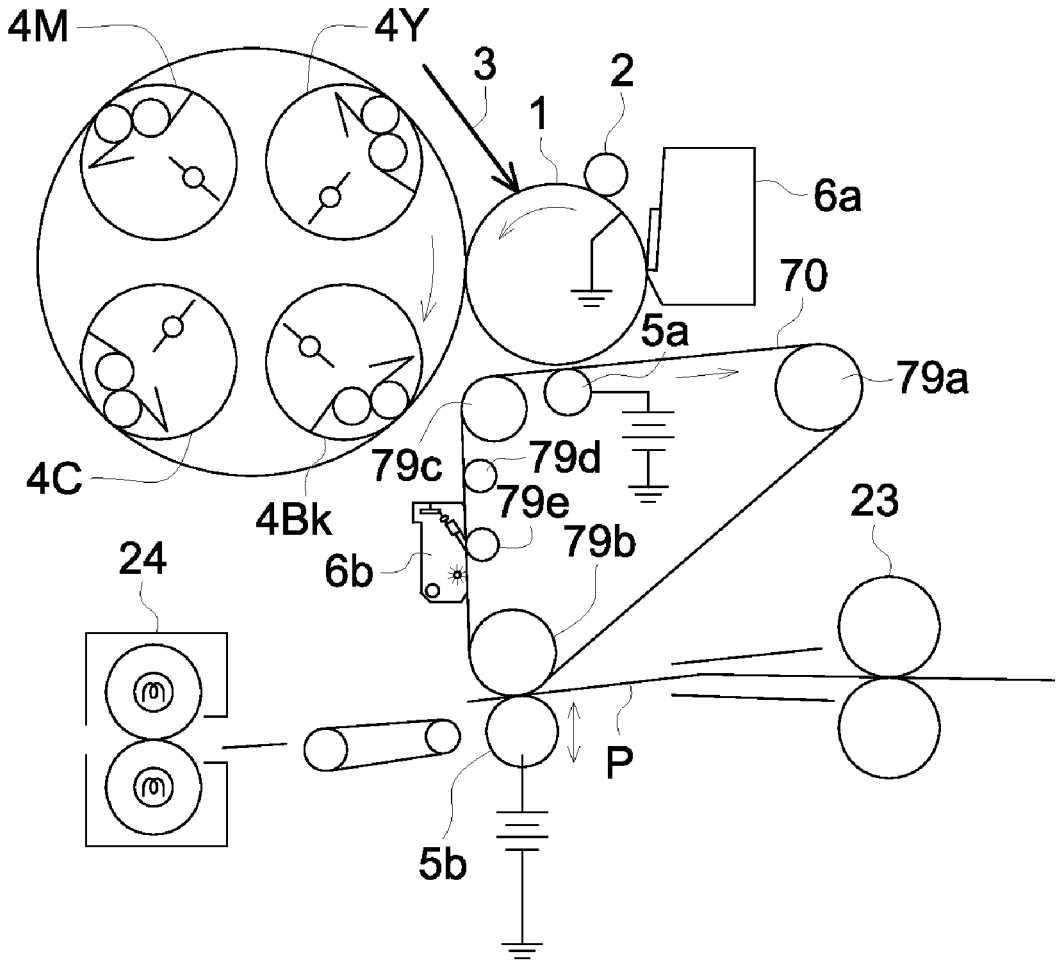
FIG. 3 illustrates a sectional view of a color image forming apparatus using a photoreceptor relating to the invention.

FIG. 3 illustrates a sectional view of a color image forming apparatus using an organic photoreceptor according to the invention (a copier or a laser beam printer which comprises, around the organic photoreceptor, an electrostatic-charging means, an exposure means, plural developing means, a transfer means, a cleaning means and an intermediate transfer means). The intermediate transfer material 70 of an endless belt than employs an elastomer of moderate resistance.

The numeral 1 designates a rotary drum type photoreceptor, which is repeatedly used as an image forming body, is rotatably driven anticlockwise, as indicated by the arrow, at a moderate circumferential speed.

The photoreceptor 1 is uniformly subjected to an electrostatic-charging treatment at a prescribed polarity and potential by a charging means 2 (charging step), while being rotated. Subsequently, the photoreceptor 1 is subjected to imagewise exposure via an imagewise exposure means 3 (imagewise exposure step) by using scanning exposure light of a laser beam modulated in correspondence to the time-series electric digital image signals of image data to form an electrostatic latent image corresponding to a yellow (Y) component image (color data) of the objective color image.

Subsequently, the electrostatic latent image is developed by a yellow toner of a first color in a yellow (Y) developing means 4Y: developing step (the yellow developing device). At that time, the individual developing devices of the second to fourth developing means 4M, 4C and 4Bk (magenta developing device, cyan developing device, black developing device) are in operation-off and do not act onto the photoreceptor 1 and the yellow toner image of the first color is not affected by the second to fourth developing devices.

The intermediate transfer material 70 is rotatably driven clockwise at the same circumferential speed as the photoreceptor 1, while being tightly tensioned onto rollers 79*a*, 79*b*, 79*c*, 79*d* and 79*e*.

The yellow toner image formed and borne on the photoreceptor 1 is successively transferred (primary-transferred) onto the outer circumferential surface of the intermediate transfer material 70 by an electric field formed by a primary transfer bias applied from a primary transfer roller 5*a* to the intermediate transfer material 70 in the course of being passed through the nip between the photoreceptor 1 and the intermediate transfer material 70.

The surface of the photoreceptor 1 which has completed transfer of the yellow toner image of the first color is cleaned by a cleaning device 6*a*.

In the following, a magenta toner image of the second color, a cyan toner image of the third color and a black toner image of the fourth color are successively transferred onto the intermediate transfer material 70 and superimposed to form superimposed color toner images corresponding to the intended color image.

A secondary transfer roller 5*b*, which is allowed to bear parallel to a secondary transfer opposed roller 79*b*, is disposed below the lower surface of the intermediate transfer material 70, while being kept in the state of being separable.

The primary transfer bias for transfer of the first to fourth successive color toner images from the photoreceptor 1 onto the intermediate transfer material 70 is at the reverse polarity of the toner and applied from a bias power source. The applied voltage is, for example, in the range of +100 V to +2 kV.

In the primary transfer step of the first through third toner images from the photoreceptor 1 to the intermediate transfer material 70, the secondary transfer roller 5*b* and the cleaning means 6*b* for the intermediate transfer material are each separable from the intermediate transfer material 70.

The superimposed color toner image which was transferred onto the intermediate transfer material 70 is transferred to a transfer material P as the second image bearing body in the following manner. Concurrently when the secondary transfer roller 5*b* is brought into contact with the belt of the intermediate transfer material 70, the transfer material P is fed at a prescribed timing from paired paper-feeding resist rollers 23, through a transfer paper guide, to the nip in contact with the belt of the intermediate transfer material 70 and the secondary transfer roller 5*b*. A secondary transfer bias is applied to the second transfer roller 5*b* from a bias power source. This secondary bias transfers (secondary-transfers) the superimposed color toner image from the intermediate transfer material 70 to the transfer material P as a secondary transfer material. The transfer material P having the transferred toner image is introduced to a fixing means 24 and is subjected to heat-fixing.

The image forming apparatus relating to the invention is not only suitably used for general electrophotographic apparatuses such as an electrophotographic copier, a laser printer, an LED printer and a liquid crystal shutter type printer, but is also broadly applicable to apparatuses employing electrophotographic technologies for a display, recording, shortrun printing, printing plate making, facsimiles and the like.

EXAMPLES

The present invention will be further described with reference to examples but the embodiments of the invention are by no means limited to these. In the following examples, "part(s)" represents part(s) by mass unless otherwise noted.

Preparation of Metal Oxide Particle 1:

Into a wet type sand mill (zirconia beads with a 0.5 mm diameter) were added 100 parts by mass of titanium oxide particles with a number average primary particle of 30 nm and produced by a plasma method (Nano Tek made by CI Nano Tek Co.), 30 parts by mass of methyl hydrogen polysiloxane as a surface treatment agent and 1000 parts by mass of methyl ethyl ketone, and mixed at 30° C. over 6 hours. Then, methyl ethyl ketone and beads were filtered out and the particles were dried at 30° C. over 6 hours to obtain metal oxide particle 1.

Preparation of Photoreceptor 1:

Photoreceptor 1 was prepared as follows.

The surface of a cylindrical aluminum support was machined to prepare an electrically conductive support with a surface roughness (Rz) of 1.5 (μm).

Intermediate Layer:

There was prepared a coating solution of an intermediate layer of the following composition.

| | |
|---|---|
| Polyamide resin (X1010, Daiseru Degusa Co., Ltd.) | 1 part |
| Titanium Oxide (SMT500SAS, Teika Co., Ltd.) | 1.1 parts |
| Ethanol | 20 parts |

Using a sand mill as a dispersing machine, dispersion was batch-wise conducted. The thus prepared coating solution was coated on the foregoing support so that a dry thickness after dried at 110° C. for 20 minutes was 2 μm.

Charge Generation Layer:

| | |
|---|---|
| Charge generation material (titanyl phthalocyanine pigment*) | 20 parts |
| Polyvinyl butyral resin (#6000-C, Denki Kagaku Kogyo Co., Ltd.) | 10 parts |
| t-Butyl acetate | 700 parts |
| 4-Methoxy-4-methyl-2-pentanone | 300 parts |

*titanyl phthalocyanine pigment exhibiting a X-ray diffraction spectrum profile having a maximum diffraction peak at 27.3° in a Cu-Kα characteristic X-ray diffraction spectrometry The foregoing mixture was dispersed by a sand mill over 10 hours to prepare a coating solution of a charge generation layer. The coating solution was coated on the foregoing intermediate layer to form a charge generation layer with a dry thickness of 0.3 μm.

Charge Transport Layer:

| | |
|---|---|
| Charge transport material (compound A) | 150 parts |
| Binder (polycarbonate Z300, Mitsubishi Gas Kagaku Co., Ltd.) | 300 parts |
| Antioxidant(Irganox 1010, Nihon Ciba Geigy K.K.) | 6 parts |
| Toluene/tetrahydrofuran (1/9 vol. %) | 2000 parts |
| Silicone oil (KF-50, Shinetsu Kagaku Co.) | 1 part |

The foregoing mixture was dissolved to prepare a coating solution of a charge transport layer. The coating solution was coated on the foregoing charge generation layer by a dip coating method and dried at 110° C. for 60 minutes to form a 20 μm thick charge transport layer.

Compound A

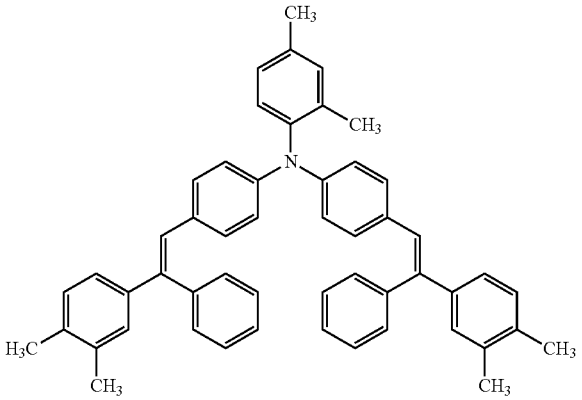

Protective Layer:

| | |
|---|---|
| Metal oxide particle 1 | 100 parts |
| Curable compound (Mc-31) | 100 parts |
| Isopropyl alcohol | 500 parts |

The foregoing components were dispersed by a sand mill for 10 hours and then, the following polymerization initiator

| | |
|---|---|
| Polymerization initiator (1-6) | 30 parts |

was added and dissolved with stirring while being light-shielded to prepare a coating solution of a protective layer (which was stocked under light-shielding). The coating solution was coated on the foregoing charge transport layer by using a circular slide hopper coating machine. After coating, the coated layer was dried at room temperature for 20 minutes (solvent drying step) and was further exposed to a metal halide lamp (500 W) at the position of 100 mm apart from the lamp over 1 minute with rotating a photoreceptor to form a 3 μm thick protective layer (ultraviolet ray-curing step). A photoreceptor 1 was thus obtained.

Preparation of Photoreceptors 2-12:

Photoreceptors 2 to 12 were each prepared in the same manner as the photoreceptor 1, except that the metal oxide particle 1 was replaced by metal oxide particles which were surface-modified with surface treatment agents, as shown in Table 1 and a mixture of metal oxide particles, a solvent and a curable compound was dispersed by a sand mill over 10 hours and a polymerization initiator shown in Table 1 was added thereto to prepare a coating solution of a protective layer.

Curing Condition (Light):

Exposure to a metal halide lamp (500 W) at the position of 100 mm apart from the lamp for 1 minute with rotating a photoreceptor to form a 3 μm thick protective layer.

Curing Condition (Heat):

Heating was carried out at 140° C. for 30 minutes to form a 3 μm thick protective layer.

TABLE 1

| | | Metal Oxide Particle | | | | | |
|---|---|---|---|---|---|---|---|
| Example No. | Photo-receptor No. | Material | Production Process | Primary Particle Size (nm) | Surface Treatment Agent | Amount by part (particle/surface treatment agent) | Part(s) |
| 1 | 1 | titanium oxide | plasma | 30 | *1 | 100/30 | 100 |
| 2 | 2 | alumina | plasma | 30 | *2 | 100/50 | 100 |
| 3 | 3 | alumina | plasma | 30 | S-15 | 100/50 | 100 |
| 4 | 4 | tin oxide | plasma | 21 | S-15 | 100/50 | 100 |
| 5 | 5 | zinc oxide | plasma | 30 | S-15 | 100/50 | 100 |
| 6 | 6 | silica | plasma | 30 | S-30 | 100/30 | 100 |
| 7 | 7 | titanium oxide | plasma | 30 | S-35 | 100/30 | 100 |
| 8 | 8 | silica | plasma | 30 | S-15 | 100/50 | 100 |
| 9 | 9 | alumina | plasma | 30 | S-30 | 100/30 | 100 |
| Comp. 1 | 10 | titanium oxide | sulfuric acid | 100 | S-15 | 100/50 | 100 |
| Comp. 2 | 11 | titanium oxide | chlorine | 60 | S-30 | 100/30 | 100 |
| Comp. 3 | 12 | silica | plasma | 30 | *1 | 100/50 | 100 |

| | Curable Compound | | | Polymerization Initiator | | |
|---|---|---|---|---|---|---|
| Example No. | Compound | Part (s) | *4 | Compound | Part (s) | Curing Condition |
| 1 | Mc-31 | 50 | 0.0098 | 1-6 | 30 | light |
| 2 | Mc-30 | 100 | 0.0077 | 1-6 | 30 | light |
| 3 | Ac-9 | 100 | 0.0067 | 1-6 | 30 | light |
| 4 | Ac-41 | 100 | 0.0091 | 1-6 | 30 | light |
| 5 | Ac-41 | 50 | 0.0091 | 1-6 | 30 | light |
| 6 | 44 | 50 | — | 1-6 | 15 | light |
| 7 | 58 | 100 | — | 5-1 | 15 | Heat |
| 8 | Ac-41 | 100 | 0.0091 | 5-1 | 30 | Heat |
| 9 | Mc-30 | 50 | 0.0077 | 1-6 | 30 | light |
| Comp. 1 | Ac-41 | 50 | 0.0091 | 1-6 | 30 | light |
| Comp. 2 | Ac-41 | 100 | 0.0091 | 1-6 | 30 | light |
| Comp. 3 | *3 | 100 | — | — | — | — |

*1: methyl hydeogen polysiloxane
*2: dimethyl hydrogen polysiloxane
*3: polycarbonate
*4: Ratio of number of functional groups to molecular weight (no. of functional group/molecular weight)

Evaluation of Photoreceptor:

The thus obtained photoreceptors 1-12 were each evaluated by using a commercially available full-color hybrid machine bizhub PRO C6500 (produced by Konica Minolta Business Technologies Inc.), in which semiconductor laser exposure of 600 dpi and 780 nm was employed. The full-color hybrid machine was provided with four image forming units and photoreceptors of the respective image forming units were unified to the same one (for example, in the case of photoreceptor 1, four photoreceptors were prepared), whereby evaluation was performed. In the respective evaluations, an A4 size image with a printing ratio of 2.5% for the respective colors of yellow (Y), magenta (M), cyan (C) and black (Bk) was printed on 500,000 sheets of A4-size neutralized paper under 30° C. and 80% RH to perform an image printing test and thereafter, evaluation was made under the respective environmental conditions, as set forth below.

Image Unsharpness:

After performing the image printing test of 500,000 sheets under an environment of 30° C. and 80% RH, the main power source of the machine was promptly powered off and after 12 hours, the source was powered on and immediately after becoming the state capable of being printed, a halftone image (0.4 of a relative reflection density measured by a Macbeth densitometer) was printed on the overall surface of A4 size neutralized paper and a 6 dot grid pattern image was printed on the whole surface of A4 size. The state of the printed images was visually observed and evaluated based on the following criteria:

A: No image unsharpness was observed in both of the halftone image and the grid pattern image (excellent), B: Only in the halftone image, a density lowering of a strip form was slightly observed in the longitudinal direction of a photoreceptor (but being acceptable in practice), C: A deficit of a grid pattern image, due to image unsharpness or thinning of line width occurred (unacceptable in practice).

Surface Flaw:

Evaluation was made before and after performing the image printing test of 500,000 sheets under an environment of 30° C. and 80% RH. The surface state of a photoreceptor was visually observed and evaluated with respect to the state of flaws based on the criteria below. The evaluated photoreceptor was one which was installed in the cyan position.

A: No surface flaw was observed after printing of 500,000 sheets (excellent),

B: One to five surface flaws were observed after printing of 500,000 sheets (acceptable in practice), C: Six or more surface flaws were observed after printing of 500,000 sheets (unacceptable in practice).

Filming:

After performing the image printing test of 500,000 sheets under an environment of 30° C. and 80% RH, and after allowed to stand for 1 hour under an environment of 20° C. and 50% RH, four image forming units of the full-color hybrid machine bizhub PRO C6500 were operated, and halftone images were printed on A4 size paper and evaluated based on the following criteria:

A: No image noise due to filming was observed (excellent),

B: An acceptable level in practice,

C: Image noise due to filming occurred and unacceptable in practice.

Dispersion Property:

Dispersion property of metal oxide particles was evaluated with respect to sedimentation when allowed to stand for one day after being dispersed, based on the following criteria:

A: No sedimentation of metal oxide particles was observed,

B: Sedimented metal oxide particles were slightly observed but at a level of being acceptable in practice, C: Sedimented metal oxide particles were observed, the supernatant fraction of liquid was transparent, which was at a level of being unacceptable in practice.

The evaluation results are shown in Table 2.

TABLE 2

| | | Evaluation | | | |
|---|---|---|---|---|---|
| Example No. | Photoreceptor No. | Surface Flaw | Dispersion Property | Filming | Image Unsharpness |
| 1 | 1 | B | B | B | A |
| 2 | 2 | B | B | B | A |
| 3 | 3 | A | A | A | B |
| 4 | 4 | A | A | A | B |
| 5 | 5 | A | A | A | B |
| 6 | 6 | B | B | B | B |
| 7 | 7 | B | B | B | B |
| 8 | 8 | A | A | A | B |
| 9 | 9 | A | A | A | A |
| Comp. 1 | 10 | B | C | C | C |
| Comp. 2 | 11 | B | C | C | C |
| Comp. 3 | 12 | C | B | C | C |

As is apparent from Table 2, it was proved that Examples 1-9 of the present invention produced results of being practically usable but Comparisons 1-3 were consequently unacceptable in practice in either of evaluation items.

What is claimed is:

1. An organic photoreceptor comprising, on an electrically conductive support, a photosensitive layer and a protective layer containing metal oxide particles, wherein the metal oxide particles are those produced by a plasma method and the protective layer is one which has been formed by curing a composition containing a curable compound and metal oxide particles, wherein the curable compound is a compound containing an acryloyl group or a methacryloyl group.

2. The organic photoreceptor of claim 1, wherein the metal oxide particles are those which have been surface-treated with a surface treatment agent containing at least one reactive organic group.

3. The organic photoreceptor of claim 2, wherein the reactive organic group is a radical-polymerizable group.

4. The organic photoreceptor of claim 3, wherein the radical-polymerizable group is one containing a carbon-carbon double bond.

5. The organic photoreceptor of claim 4, wherein the radical-polymerizable group is an acryloyl group or a methacryloyl group.

6. The organic photoreceptor of claim 1, wherein the metal oxide particles are particles of a metal oxide selected from the group consisting of silica, titanium oxide, alumina, zinc oxide and tin oxide.

7. The organic photoreceptor of claim 1, wherein the metal oxide particles exhibit a number average primary particle size of 1 to 300 nm.

8. The organic photoreceptor of claim 1, wherein the metal oxide particles exhibit a number average primary particle size of 3 to 100 nm.

9. A method of preparing an organic photoreceptor comprising, on an electrically conductive support, a photosensitive layer and a protective layer containing metal oxide particles, the method comprising the steps of:

coating a composition containing metal oxide particles and a curable compound on the photosensitive layer and allowing the curable compound to be cured to form the protective layer, wherein the metal oxide particles are those produced by a plasma method and the curable compound is a compound containing an acryloyl group or a methacryloyl group.

10. The method of claim 9, wherein the metal oxide particles are those which have been surface-treated with a surface treatment agent containing at least one reactive organic group.

11. The method of claim 10, wherein the reactive organic group is a radical-polymerizable group.

12. The method of claim 11, wherein the radical-polymerizable group is one containing a carbon-carbon double bond.

13. The method of claim 12, wherein the radical-polymerizable group is an acryloyl group or a methacryloyl group.

14. The method of claim 9, wherein the metal oxide particles are particles of a metal oxide selected from the group consisting of silica, titanium oxide, alumina, zinc oxide and tin oxide.

15. The method of claim 9, wherein the metal oxide particles exhibit a number average primary particle size of 1 to 300 nm.

16. The method of claim 9, wherein the metal oxide particles exhibit a number average primary particle size of 3 to 100 nm.

* * * * *